US007535429B2

(12) United States Patent
Kanno et al.

(10) Patent No.: US 7,535,429 B2
(45) Date of Patent: May 19, 2009

(54) VARIABLE SLOT ANTENNA AND DRIVING METHOD THEREOF

(75) Inventors: Hiroshi Kanno, Osaka (JP); Ushio Sangawa, Nara (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 12/179,096

(22) Filed: Jul. 24, 2008

(65) Prior Publication Data

US 2009/0021439 A1 Jan. 22, 2009

Related U.S. Application Data

(63) Continuation of application No. PCT/JP2007/060551, filed on May 23, 2007.

(30) Foreign Application Priority Data

May 25, 2006 (JP) ..... 2006-144800

(51) Int. Cl.
*H01Q 13/10* (2006.01)

(52) U.S. Cl. ..... 343/767

(58) Field of Classification Search ..... 343/767, 343/770, 700 MS, 771, 850, 862, 864
See application file for complete search history.

(56) References Cited

U.S. PATENT DOCUMENTS 5,268,696 A 12/1993 Buck et al.
5,442,367 A 8/1995 Naito et al.
5,539,420 A 7/1996 Dusseux et al.
6,150,989 A 11/2000 Aubry
6,285,333 B1 * 9/2001 Reed et al. ..... 343/767
6,292,153 B1 9/2001 Aiello et al.

(Continued)

FOREIGN PATENT DOCUMENTS

EP 1 158 605 A1 11/2001

(Continued)

OTHER PUBLICATIONS

Lei Zhu, "A Novel Broadband Microstrip-Fed Wide Slot Antenna With Double Rejection Zeros", IEEE Antennas and Wireless Propagation Letters, 2003, pp. 194-196, vol. 2, IEEE.

(Continued)

*Primary Examiner*—Hoang V Nguyen
*Assistant Examiner*—Robert Karacsony
(74) *Attorney, Agent, or Firm*—McDermott Will & Emery LLP

(57) ABSTRACT

A variable directivity slot antenna includes: ground conductors 101*a* and 101*b*, which are divided by a slot region 109 both of whose ends are open ends 111*a* and 111*b*; a feed line 115 having a loop shape at a feeding site 113 for the slot region 109; a first selective conduction path 119 connecting between the ground conductors 101*a* and 101*b* in a direction of the open end 111*a* as viewed from the feeding site 113; and a second selective conduction path 121 connecting between the ground conductors 101*a* and 101*b* in a direction of the open end 111*b* as viewed from the feeding site 113. Depending on the driving state, the first selective conduction path 119 and the second selective conduction path 121 are controlled into a conducting or open state.

22 Claims, 26 Drawing Sheets

U.S. PATENT DOCUMENTS

| | | | |
|---|---|---|---|
| 6,366,254 | B1 | 4/2002 | Sievenpiper |
| 2003/0020664 | A1 | 1/2003 | Thudor et al. |
| 2003/0122721 | A1 | 7/2003 | Sievenpiper |
| 2003/0222824 | A1 | 12/2003 | Louzir et al. |
| 2005/0162327 | A1 | 7/2005 | Mori |
| 2005/0162328 | A1 | 7/2005 | Mori |
| 2005/0200530 | A1 | 9/2005 | Aikawa et al. |
| 2006/0044200 | A1 | 3/2006 | Mori |
| 2007/0080881 | A1 | 4/2007 | Thudor et al. |

FOREIGN PATENT DOCUMENTS

| | | |
|---|---|---|
| JP | 31-464 | 1/1956 |
| JP | 3-65681 | 3/1991 |
| JP | 3224323 | 10/1991 |
| JP | 5-14034 | 1/1993 |
| JP | 06-085520 | 3/1994 |
| JP | 2654248 | 9/1997 |
| JP | 10-256826 | 9/1998 |
| JP | 11-46115 | 2/1999 |
| JP | 2882928 | 2/1999 |
| JP | 2951707 | 7/1999 |
| JP | 2002-084130 | 3/2002 |
| JP | 3360118 | 10/2002 |
| JP | 2003-101337 | 4/2003 |
| JP | 2003-527018 | 9/2003 |
| JP | 2004-007705 | 1/2004 |
| JP | 2004-129234 | 4/2004 |
| JP | 2004-304226 | 10/2004 |
| JP | 2004-304705 | 10/2004 |
| JP | 2004-336328 | 11/2004 |
| JP | 2005-079972 | 3/2005 |
| JP | 2005-514844 | 5/2005 |
| JP | 2005-210520 | 8/2005 |
| JP | 2005-210521 | 8/2005 |
| JP | 2005-217667 | 8/2005 |
| JP | 2006-005679 | 1/2006 |
| JP | 2006-066993 | 3/2006 |
| JP | 2006-310927 | 11/2006 |
| WO | WO 2005/081360 A1 | 1/2005 |
| WO | WO 2005/013419 A1 | 2/2005 |
| WO | WO/2005-125034 | 12/2005 |

OTHER PUBLICATIONS

Co-pending U.S. Continuation of Application under 111a entitled "Variable Slot Antenna and Driving Method Thereof", filed on Jul. 24, 2008.

Japanese Office Action, with English Translation, issued in Japanese Patent Application No. JP 2007-554778 dated on Mar. 18, 2008.

* cited by examiner

-- PRIOR ART --

-- PRIOR ART --

-- PRIOR ART --

-- PRIOR ART --

-- PRIOR ART --

-- PRIOR ART --

-- PRIOR ART --

-- PRIOR ART --

VARIABLE SLOT ANTENNA AND DRIVING METHOD THEREOF

This is a continuation of International Application No. PCT/JP2007/060551, with an international filing date of May 23, 2007, which claims priority of Japanese Patent Application No. 2006-144800, filed on May 25, 2006, the contents of which are hereby incorporated by reference.

BACKGROUND OF THE INVENTION

1. Field of the Invention

The present invention relates to directivity switchability in an antenna having wideband characteristics suitable for the transmission or reception of a digital signal or an analog high-frequency signal, e.g., that of a microwave range or an extremely high frequency range.

2. Description of the Related Art

For two reasons, wireless devices are desired which are capable of operating in a much wider band than conventionally. A first reason is the need for supporting short-range wireless communication systems, for which the authorities have given permission to use a wide frequency band. A second reason is the need for a single terminal device that is capable of supporting a plurality of communication systems which use different frequencies.

For example, a frequency band from 3.1 GHz to 10.6 GHz, which has been allocated by the authorities to short-range fast communication systems, corresponds to a bandwidth ratio as wide as 109.5%. As used herein, "a bandwidth ratio" is a bandwidth, normalized by the center frequency f0, of a band. Patch antennas have bandwidth ratio characteristics of less than 5%, and ½ wavelength slot antennas have bandwidth ratio characteristics of less than 10% (both known as basic antenna structures), but with such bandwidth ratio characteristics, it is very difficult cover the entirety of the aforementioned band. To take for example the frequency bands which are currently used for wireless communications around the world, a bandwidth ratio of about 30% is required in order to cover from the 1.8 GHz band to the 2.4 GHz band with the same antenna. In order to simultaneously cover from the 800 MHz band to the 2.4 GHz band, a bandwidth ratio of 100% or more is required. Thus, as the number of systems to be supported by the same terminal device increases, and as the frequency band to be covered becomes wider, the need will increase for a wideband antenna, this being a solution for realizing a simple terminal device structure. Moreover, since a stronger need to suppress reflected interference waves has emerged due to signals becoming faster, it is strongly desired to realize an antenna which has not only wideband characteristics but also directivity switching properties while having a small shape. In the case of a wireless system in which wideband signals are globally used, it is necessary to realize an antenna which satisfies all of: wideband characteristics; directivity switching properties; and maintenance of the main beam direction within a wide operating band, while having a small shape.

The ¼ wavelength slot antenna, shown in schematic diagrams in FIGS. 25A to 25C, is one of the most basic planar antenna structures, and is known to attain a bandwidth ratio value of about 15%. FIG. 25A is an upper schematic see-through view; FIG. 25B is a schematic cross-sectional view taken along line AB; and FIG. 25C is a schematic see-through rear view, as seen through the upper face side.

As is shown in these figures, a feed line 115 exists on the upper face of a dielectric substrate 103. A recess is formed in the depth direction from an edge 105 of a finite ground conductor 101, which in itself is provided on the rear face. Thus, the recess functions as a slot 109 having an open end 111. The slot 109 is a circuit which is obtained by removing the conductor completely across the thickness direction in a partial region of the ground conductor 101, and exhibits a lowest-order resonance phenomenon near a frequency such that its slot length Ls corresponds to a ¼ effective wavelength. The feed line 115, which partly opposes and intersects the slot 109, excites the slot 109. The feed line 115 is connected to an external circuit via an input terminal 201. Note that, in order to establish input matching, a distance t3 from an open end point 125 of the feed line 115 to the slot 109 is typically set to a length of about a ¼ effective wavelength at the center frequency f0.

Japanese Laid-Open Patent Publication No. 2004-336328 (hereinafter "Patent Document 1") discloses a structure for operating a ¼ wavelength slot antenna at a plurality of resonant frequencies. FIG. 26A shows a schematic structural diagram thereof. A ¼ wavelength slot 109, which recesses into a partial region of a ground conductor 101 on the rear face of the dielectric substrate 103, is excited at a feeding site 113, whereby a usual antenna operation occurs. Usually, the resonant frequency of a slot antenna is defined by a loop length of the slot 109. However, a capacitor element 16 which is provided between a point 16*a* and a point 16*b* according to Patent Document 1 is prescribed so as to allow a signal of any frequency that is higher than the intended resonant frequency of the slot 109 to pass through, thus making it possible to vary the resonator length Ls of the slot based on frequency. Specifically, at lower frequencies, as shown in FIG. 26B, the resonator length of the slot does not change from its usual value, and therefore is determined by the physical length of the recess structure. At higher frequencies, as shown in FIG. 26C, the antenna operates so that the slot has a resonator length Ls2 which is shorter than its physical resonator length Ls in high-frequency terms. Thus, Patent Document 1 describes that a single slot resonator structure can attain a multiple resonance operation.

Non-Patent Document 1 ("A Novel Broadband Microstrip-Fed Wide Slot Antenna With Double Rejection Zeros" IEEE Antennas and Wireless Propagation Letters, vol. 2, 2003, pages 194 to 196) discloses a method for realizing a wideband operation of a ½ wavelength slot antenna. As mentioned above, one input matching method for the slot antenna shown in FIG. 25 has conventionally been to excite the slot resonator 109 at a point where a ¼ effective wavelength at the center frequency f0 is obtained, beginning from the open end point 125 of the feed line 115.

However, in Non-Patent Document 1, as shown in FIG. 27 (which shows an upper schematic see-through view), the line width of a feed line 115 is reduced in a region spanning a distance corresponding to a ¼ effective wavelength at f0, from an open end point 125 of the feed line 115 toward an input terminal 201, thus forming a resonator. The resultant inductive resonator region 127 is coupled to a slot 109 in an approximate center thereof.

Non-Patent Document 1 describes that the introduction of the inductive resonator region 127 increases the number of resonators operating near the operating band into two within the circuitry, these resonators being strongly coupled to each other, so that a multiple resonance operation is obtained. FIG. 2(b) of Non-Patent Document 1 corresponds to a frequency dependence of return intensity characteristics in the case where: a substrate having a dielectric constant 2.94 and a height of 0.75 mm is used; a slot length (Ls) of 24 mm and a design frequency of 5 GHz are assumed; a ¼ wavelength line in the inductive resonator region of the feed line 115 has a line-length (t1+t2+Ws) of 9.8 mm, with a line width W2 of 0.5 mm; and the offset distance (Lo) between the feed line 115 and the slot center is varied from 9.8 mm to 10.2 mm. Under any of these offset distance conditions, return intensity characteristics as good as −10 dB or less are obtained with a bandwidth ratio 32% (from near 4.1 GHz to near 5.7 GHz). As shown in comparison with respect to the measured characteristics in FIG. 4 of Non-Patent Document 1, such band characteristics are much better than the bandwidth ratio of 9% of a usual slot antenna which is supposedly produced under the same substrate conditions.

On the other hand, various techniques have been proposed over the years for changing the directivity of an antenna and subjecting an emitted beam for scanning. For example, some methods, e.g., adaptive arrays, allow a signal which is received via a plurality of antennas to be processed in a digital signal section to equivalently realize a beam scanning. Other methods, e.g., sector antennas, place a plurality of antennas in different orientations in advance, and switch the main beam direction through switching of a path on the feed line side. There are also methods which place reflectors and directors (which are unfed elements) near an antenna to tilt the main beam direction.

Japanese National Phase PCT Laid-Open Publication No. 2003-527018 (hereinafter "Patent Document 2") discloses, as a sector antenna utilizing a slot antenna, a sector antenna structure in which a plurality of slot antennas are radially placed to realize switching of the main beam direction through switching of a path on the feed line side. In Patent Document 2, a Vivaldi antenna which is known to have ultra-wideband antenna characteristics is used as an antenna to realize global switching of the main beam direction of emitted electromagnetic waves having ultrawideband frequency components.

Moreover, Japanese Laid-Open Patent Publication No. 2005-210520 (hereinafter "Patent Document 3") discloses an example of a variable antenna which employs unfed parasitic elements for tilting a main beam direction in which emission from a radiation slot element occurs. In the variable antenna shown in FIG. 28, in proximity, a ½ effective wavelength slot resonator which is excited by a feed line 115 as a radiator (slot) 109 and unfed slot resonators serving as parasitic elements 109*x* and 109*y* are placed on a ground conductor 101. Through adjustment of the slot lengths of the parasitic elements 109*x* and 109*y*, switching can be made as to whether the parasitic elements function as directors or reflectors relative to a reflector, thus varying the direction of an emitted beam from the radiator. In order to allow the parasitic elements 109*x* and 109*y* to function as directors, the slot lengths of the parasitic elements may be adjusted to be shorter than the slot length of the radiator. In order to allow the parasitic elements 109*x* and 109*y* to function as reflectors, the slot lengths of the parasitic elements may be adjusted to be longer than the slot length of the radiator. In order to adjust a slot length, a slot length which is longer than necessary is prescribed on the circuit board; and, in a state of allowing the element to function as a slot circuit with a short slot length, somewhere along the slot length, selectively conduction is achieved by means of a switching element 205*a* or 205*b* so as to astride the slot along the width direction between portions of ground conductor. Patent Document 3 mentions use of MEMS switches as an exemplary method of implementing the switching elements 205*a* and 205*b*.

In conventional slot antennas, it has been impossible, with a small structure, to simultaneously satisfy all of: wideband-ness; maintenance of the main beam direction within the operating band; and a function of globally switching the main beam direction in a drastic manner.

Firstly, the operating band of a usual slot antenna, which only has a single resonator structure within its structure, is restricted by the band of its resonance phenomenon. As a result of this, the frequency band in which good return intensity characteristics can be obtained only amounts to a bandwidth ratio of about 10% to 15%.

On the other hand, although the antenna of Patent Document 1 realizes a wideband operation because of a capacitive reactance element being introduced in the slot, it fails to disclose any function of drastically switching directivity. Moreover, it is well conceivable that an additional part such as a chip capacitor is required as the actual capacitive reactance element, and that variations in the characteristics of the newly-introduced additional part may cause the antenna characteristics to vary. Moreover, Patent Document 1 fails to disclose any directivity switching function of globally switching the main beam direction of an antenna with wideband characteristics.

Also in the example of Non-Patent Document 1, where a plurality of resonators are introduced in the structure in order to improve the band characteristics based on coupling between the resonators, the bandwidth ratio characteristics are only as good as about 35%, which needs further improvement. The upper schematic see-through view of FIG. 27 (which is modeled after FIG. 1 of Non-Patent Document 1) illustrates the slot width Ws to be of a small dimension. However, under the conditions for obtaining the aforementioned wideband characteristics, the slot width Ws will have to be set to 5 mm, which accounts for more than half of the length of ¼ wavelength region, i.e., 9.8 mm. When a desire for downsizing the antenna permits only a limited area for accommodating the slot, it may become necessary to fold up the linear-shaped slot, for example. Thus, a structure which requires a large Ws value in order to obtain wideband characteristics will be difficult to be downsized by nature. Furthermore, Non-Patent Document 1 fails to disclose any directivity switching function of globally switching the main beam direction of an antenna with wideband characteristics.

In the antenna disclosed in Patent Document 2, four slot antennas, most of whose constituent elements are not shared, are radially placed within the structure, and a driving method is used which switches the feed circuit for each slot antenna, whereby a function of switching the main beam direction is realized. However, the antenna structure is very large, thus presenting a problem in realizing a small-sized communication terminal.

In the antenna disclosed in Patent Document 3, too, slot antennas whose constituent elements are not shared are placed in parallel, thus presenting a problem from the standpoint of downsizing. Moreover, there is only a limited frequency band in which the slot antennas to be used as parasitic elements function as directors or reflectors, thus resulting in a problem in that the main beam direction of the antenna may possibly change to a different direction within the operating frequency band. Therefore, the antenna disclosed in Patent Document 3 fails to satisfy the requirement as to maintenance of the main beam direction within the band.

SUMMARY OF THE INVENTION

The present invention solves the aforementioned conventional problems, and an objective thereof is to provide a variable slot antenna and a driving method thereof, in which, while maintaining a small circuit structure and maintaining the same main beam direction across the entirety of a wide operating band, a function of globally switching the main beam direction in a drastic manner is realized.

According to the present invention, there is provided a variable directivity slot antenna comprising:

a dielectric substrate; and a ground conductor and a slot region formed on a rear face of the dielectric substrate, the ground conductor having a finite area, wherein, the slot region divides the ground conductor into a first ground conductor and a second ground conductor;

both leading ends of the slot region are open ends;

at least two selective conduction paths are further provided on the rear face of the dielectric substrate, the at least two selective conduction paths traversing the slot region to connect the first ground conductor and the second ground conductor;

a feed line intersecting the slot region at a feeding site near a center of the slot region along a longitudinal direction thereof is provided on a front face of the dielectric substrate;

the at least two selective conduction paths include a first selective conduction path and a second selective conduction path;

a slot resonator length Ls is defined as a distance between the first selective conduction path and the open end of the slot region located at the leading end in an −X direction;

a slot width Ws is defined as a distance between the first ground conductor and the second ground conductor;

a distance between the second selective conduction path and the open end of the slot region located at the leading end in an X direction is equal to the slot resonator length Ls;

when Ws is equal to or less than (Ls/8), Ls is prescribed equal to a ¼ effective wavelength at a center frequency f0 of an operating band;

when Ws exceeds (Ls/8), (2Ls+Ws) is prescribed equal to a ½ effective wavelength at the center frequency f0 of the operating band;

in a see-through plan view in which the variable directivity slot antenna is seen through from a normal direction of the dielectric substrate, the feed line appears interposed between the first selective conduction path and the second selective conduction path;

the X direction is defined as the longitudinal direction of the slot region, a Y direction is defined as a longitudinal direction of the feed line, and a Z direction is defined as the normal direction of the dielectric substrate;

the first selective conduction path is disposed between the open end of the slot region located at the leading end in the X direction and the feeding site, and the second selective conduction path is disposed between the open end of the slot region located at the leading end in the −X direction and the feeding site;

in a first state, the first selective conduction path is selected to be in a conducting state and the second selective conduction path is selected to be in an open state, thus causing a main beam to be emitted in the −X direction;

in a second state, the first selective conduction path is selected to be in an open state and the second selective conduction path is selected to be in a conducting state, thus causing a main beam to be emitted in the X direction;

the feed line once branches into a group of branch lines including two or more branch lines at a first point near the feeding site, and two or more branch lines in the group of branch lines become again connected at a second point near the slot, thus forming a loop line in the feed line; and a maximum value of a loop length of the entire loop line is prescribed to be a length less than 1×effective wavelength at an upper limit frequency of the operating band.

In accordance with a variable slot antenna of the present invention, a wideband operation can be realized with a small structure, which has been difficult to realize with conventional slot antennas. Moreover, since it is possible to simultaneously attain maintenance of the main beam direction within the operating band and a function of globally switching the main beam direction in a drastic manner, it becomes possible to utilize ultrawideband fast communications and realize a functional multiband terminal device in the context of a mobile terminal device which is in a constantly-changing transmission/reception situation.

Other features, elements, processes, steps, characteristics and advantages of the present invention will become more apparent from the following detailed description of preferred embodiments of the present invention with reference to the attached drawings.

BRIEF DESCRIPTION OF THE DRAWINGS

FIG. 1A illustrates a case where the main beam direction is oriented toward the right; and FIG. 1B illustrates a case where the main beam direction is oriented toward the left.

FIG. 2A is a cross-sectional structural diagram taken along line A1-A2 in FIG. 1A; and FIG. 2B is cross-sectional structural diagram taken along line B1-B2 in FIG. 1A.

FIG. 3A illustrates a case where no inductive resonator region is included in the power-feeding structure; and FIG. 3B illustrates a case where an inductive resonator region is included in the power-feeding structure.

FIG. 4A illustrates a loop line structure; FIG. 4B illustrates an open-ended stub line structure; and FIG. 4C illustrates a loop line structure, where a second path is made extremely short.

FIG. 6A illustrates a traditional transmission line; and FIG. 6B illustrates a branching transmission line.

FIG. 11A is a schematic diagram corresponding to the driving condition of FIG. 1A; and FIG. 11B is a schematic diagram corresponding to the driving condition of FIG. 1B.

FIG. 21A is a radiation characteristics comparison diagram at 2.5 GHz, in first and second driving states; and FIG. 21B is a radiation characteristics comparison diagram at 4.5 GHz, in first and second driving states.

FIG. 24A is a radiation characteristics comparison diagram at 3 GHz, in first and second driving states; FIG. 24B is a radiation characteristics comparison diagram at 6 GHz, in first and second driving states; and FIG. 24C is a radiation characteristics comparison diagram at 9 GHz, in first and second driving states.

FIG. 25A is an upper schematic see-through view; FIG. 25B is a cross-sectional side schematic view; and FIG. 25C is a rear schematic view as seen through an upper face.

DETAILED DESCRIPTION OF PREFERRED EMBODIMENTS

Hereinafter, embodiments of the present invention will be described with reference to the drawings.

Embodiments

Figure 1B:
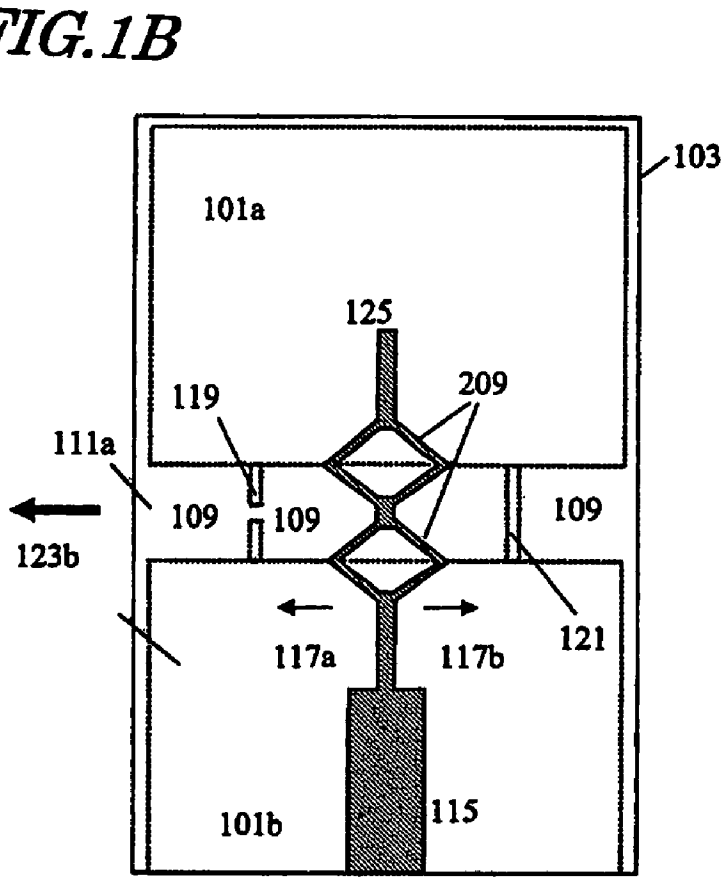
FIGS. 1A and 1B are schematic see-through views of a variable slot antenna which is driven by a driving method according to the present invention.
Figure 1A:
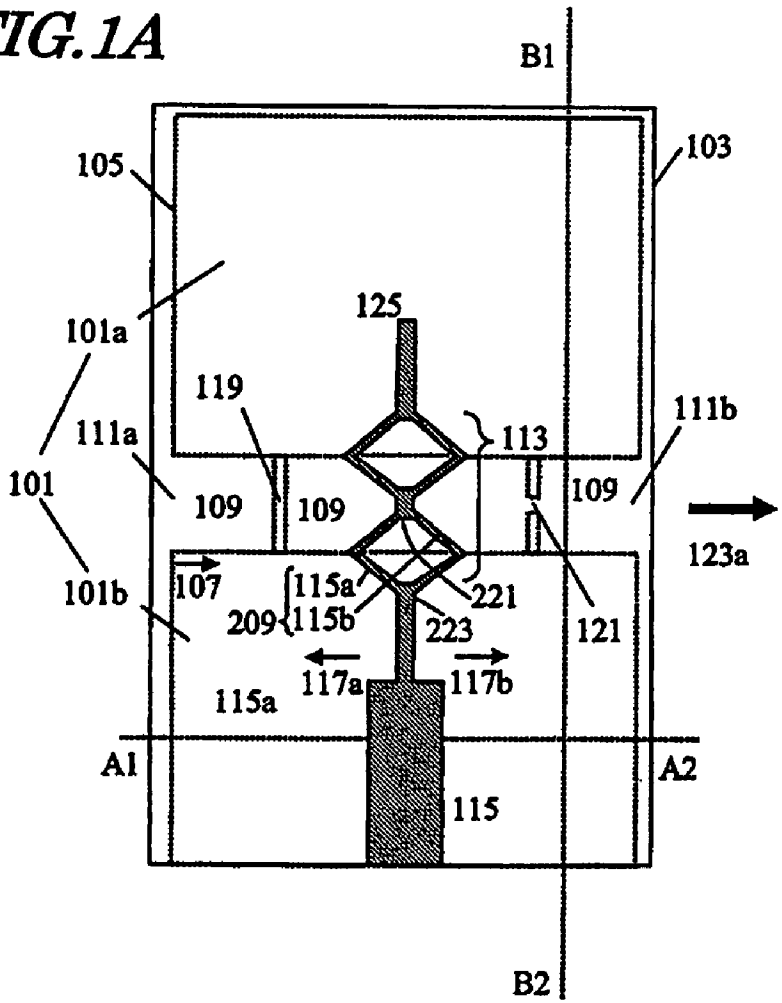
Figure 2A:
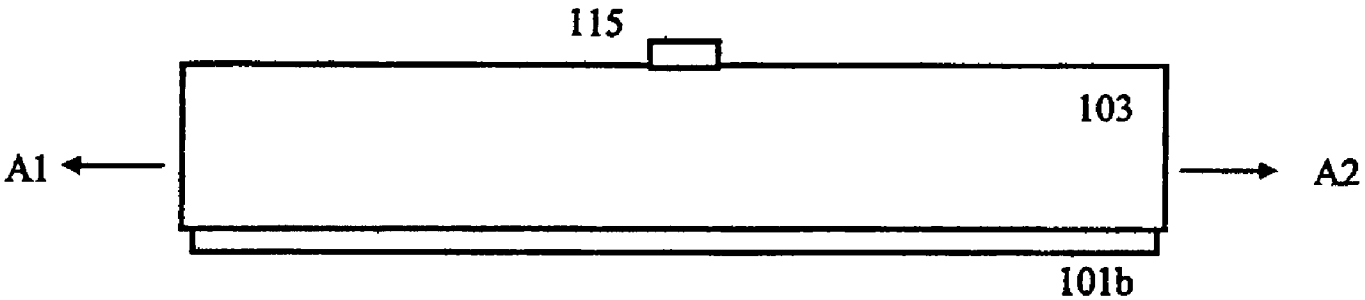
FIGS. 2A and 2B are cross-sectional structural diagrams of a variable slot antenna which is driven by the driving method according to the present invention.
Figure 2B:
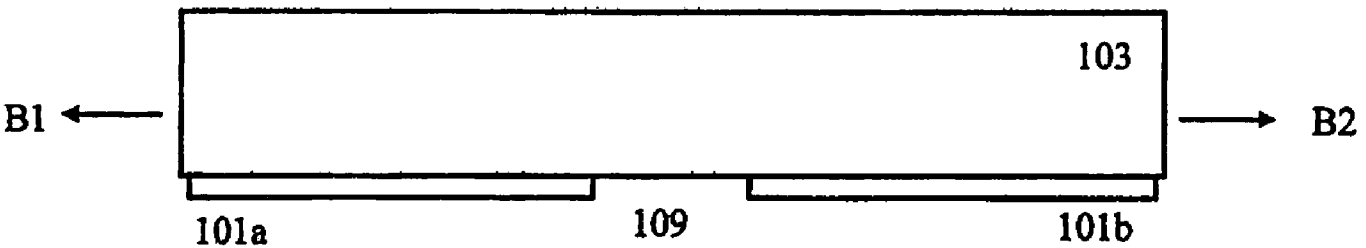

FIGS. 1A and 1B are upper schematic see-through views showing the structure of a variable slot antenna according to the present embodiment, and schematically illustrate switchability as to directivity characteristics of the variable slot antenna obtained in two driving states. FIGS. 2A and 2B show schematic cross-sectional views of the structure taken along lines A1-A2 and B1-B2 in FIGS. 1A and 1B. For simplicity of discussion, a variable slot antenna structure which is symmetric between right and left will be illustrated as an example of a high-symmetry embodiment, and an embodiment of a driving method which involves switching the main beam direction toward the right or left will be described.

A ground conductor 101 having a finite area is formed on a rear face of a dielectric substrate 103, and a slot region 109 is formed which recesses into the ground conductor 101 in a depth direction 107 from a side outer edge 105, both ends of the slot region 109 being left open. In other words, the finite ground conductor 101 is split by the slot region 109 into two: a first ground conductor 101*a* and a second ground conductor 101*b*. As a result, both ends of the slot region 109 become a first open end 111*a* and a second open end 111*b*. At a feeding site 113 in the center of the slot region 109, the slot region 109 intersects a feed line 115 which is formed on the front face of the dielectric substrate 103. When the direction of the first open end 111*a* as viewed from the feeding site 113 is defined as a first direction 117*a*, at least one first selective conduction path 119 is formed in the first direction from the feeding site 113. Similarly, when the direction of the second open end 111*b* as viewed from the feeding site 113 is defined as a second direction 117*b*, at least one second selective conduction path 121 is formed in the second direction from the feeding site 113. For simplicity of discussion, a case will be first described where there is one first selective conduction path 119 and one second selective conduction path 121. In other words, as shown in FIGS. 1A and 1B, the selective conduction paths 119 and 121 are disposed on the left side and the right side of the feeding site 113, one each. Based on an externally-supplied control signal, the first selective conduction path 119 and the second selective conduction path 121 may each permit selective conduction between the first ground conductor 101*a* and the second ground conductor 101*b*, which are split apart by the slot region 109. FIG. 1A illustrates a state where the first selective conduction path 119 is controlled to be conducting and the second selective conduction path 121 to be open. Conversely, FIG. 1B illustrates a state where the first selective conduction path 119 is controlled to be open and the second selective conduction path 121 to be conducting. Through such control of the first and second selective conduction paths, it becomes possible to orient the main beam direction of emitted electromagnetic waves in the direction of an arrow 123*a* in the state of FIG. 1A or in the direction of an arrow 123*b* in the state of FIG. 1B.

(Outline of Power-Feeding Structure)

In the variable slot antenna of the present embodiment, the feed line 115 branches into at least two or more branch lines 115*a*, 115*b* . . . , etc., at a first branching point 223 near the feeding site 113. The set of branch lines 115*a* and 115*b* again become connected at a second branching point 221, thus forming a loop line 209. Some of these branch lines may form short open stub structures which do not constitute parts of the loop line, but their stub length is prescribed to be less than ¼ of the effective wavelength at the upper limit frequency fH in the operating band. Moreover, the loop length of the loop line 209 is prescribed to be less than 1×effective wavelength at fH. As shown in FIGS. 1A and 1B, it is preferable that two loop lines are provided so as to respectively intersect the two border lines between the slot region 109 and the ground conductors 101*a* and 101*b*.

(Usual Matching Condition—Wideband)

Figure 3B:
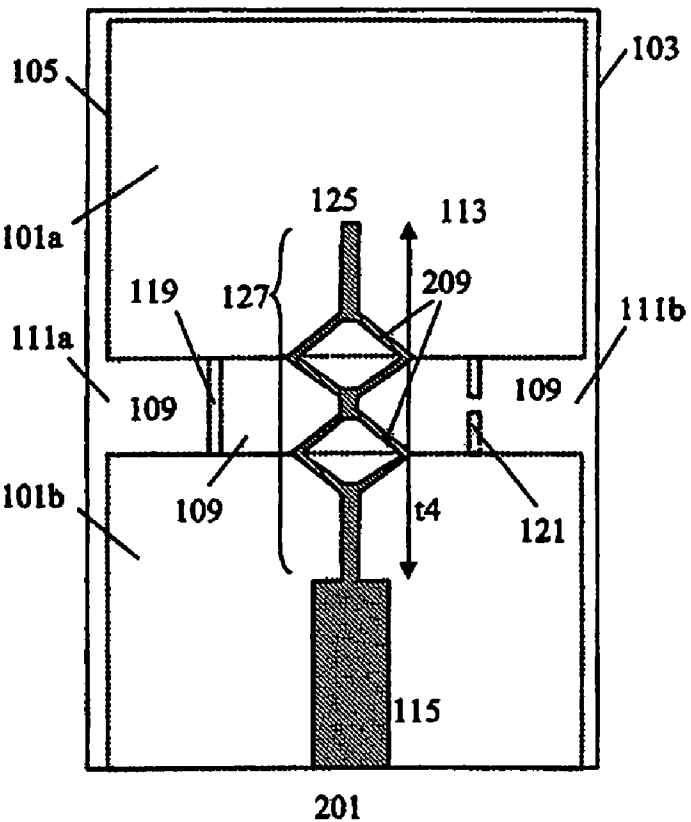
FIGS. 3A and 3B are schematic see-through views of a variable slot antenna according to the present invention.
Figure 3A:
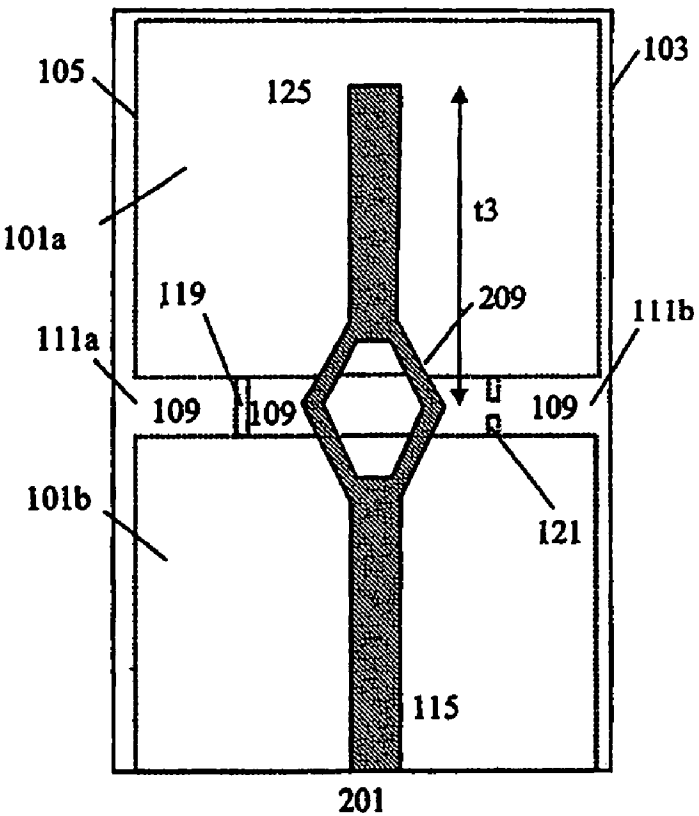

In the variable slot antenna according to the present invention, two kinds of feed line structures can be adopted, as shown in the upper schematic see-through views of FIGS. 3A and 3B. In the structure shown in a schematic see-through view (through the upper face) of FIG. 3A, a distance t3 from an open end point 125 of the feed line 115 to the central portion of the slot region 109 along the width direction is prescribed equal to a ¼ effective wavelength at f0, whereby input matching is established in an operating band containing f0. The characteristic impedance of the feed line 115 is preferably prescribed at 50Ω.

(Feeding Condition for Ultrawideband Characteristics)

The variable slot antenna according to the present invention may also have a feed line structure as shown already in FIGS. 1A and 1B and in the upper schematic see-through view of FIG. 3B. That is, it may be a power-feeding structure such that a region of the feed line 115 spanning a distance of (t1+Ws+t2) from the open end point 125 toward the input terminal is designated to be an inductive resonator region 127, composed of a transmission line whose characteristic impedance is higher than 50Ω. Preferably, it is ensured that an impedance Zo of a commonly-used external circuit that is connected to the input terminal 201 is equal to the characteristic impedance of the feed line 115. If the impedance of the external circuit is not 50Ω, the characteristic impedance of the inductive resonator region is set to an even higher value. In the example shown in FIGS. 3A and 3B, the length of the inductive resonator region is prescribed approximately equal to the ¼ effective wavelength at f0. Preferably, the slot width Ws is prescribed approximately equal to a sum of t1 and t2. The structure shown in FIG. 3A would be effective for obtaining wideband characteristics under conditions which necessitate a narrow slot width Ws. The structure shown in FIG. 3B would be effective for obtaining ultrawideband characteristics under conditions which do not impose any limitations to the slot width Ws.

(Function of Loop Line 209)

The loop line 209 of a variable slot antenna according to the present invention serves the two functions of: increasing the number of places where the slot resonator is excitable to more than one; and adjusting the electrical length of the input matching circuit, whereby an ultrawideband antenna operation is realized. Hereinafter, the functions of the loop line will be specifically described.

Figures 4A, 4B, 4C:
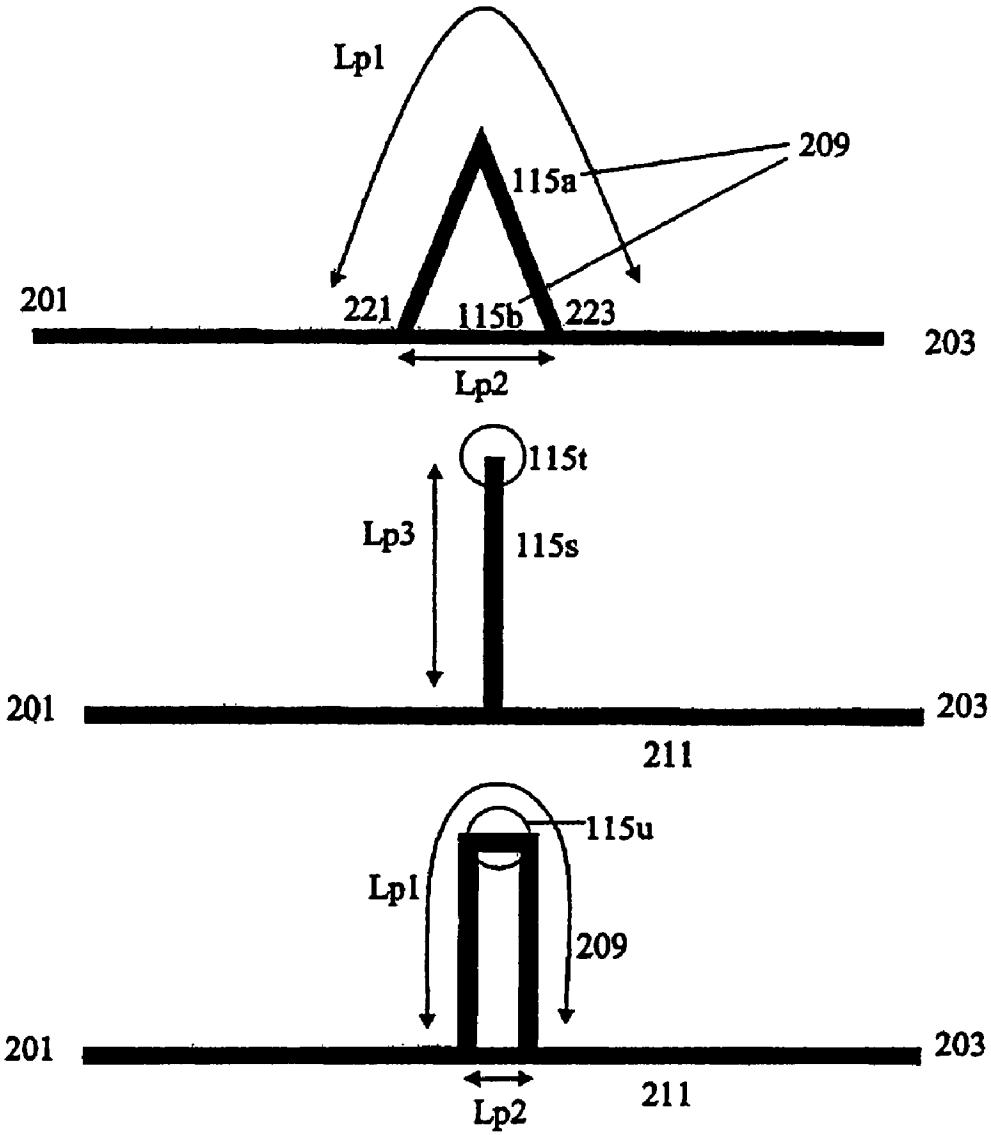
FIGS. 4A, 4B, and 4C are schematic diagrams showing two possible circuits for a traditional high-frequency circuit structure having an infinite ground conductor structure on its rear face, each circuit having a branching portion along a signal line.

First, high-frequency characteristics in the case where a loop line structure is adopted in a traditional high-frequency circuit will be described, assuming that a ground conductor having an infinite area is present on a rear face thereof. FIG. 4A shows a schematic diagram of a circuit in which a loop line 209, composed of a first path 115*a* and a second path 115*b*, is connected between an input terminal 201 and an output terminal 203. The loop line satisfies a resonance condition under the conditions where a sum of the path length Lp1 of the first path 115*a* and a path length Lp2 of the second path 115*b* equals 1×effective wavelength of the transmission signal, and thus may sometimes be employed as a ring resonator. However, when Lp1 and Lp2 are shorter than the effective wavelength of the transmission signal, the loop line 209 does not exhibit a steep frequency response, and therefore it has not been particularly necessary to employ such a loop line 209 in a usual high-frequency circuit. In a traditional high-frequency circuit having a uniform ground conductor, even if fluctuations occur in the local high-frequency current distribution due to the introduction of a loop line, macroscopic fluctuations in the high-frequency characteristics between the two terminals 201 and 203 will be averaged out. In other words, the high-frequency characteristics of the loop line in a non-resonating state will not be much different from the high-frequency characteristics of a transmission line in which two paths are replaced by a single path whose characteristics represent an average of those of the two paths.

Figure 5:
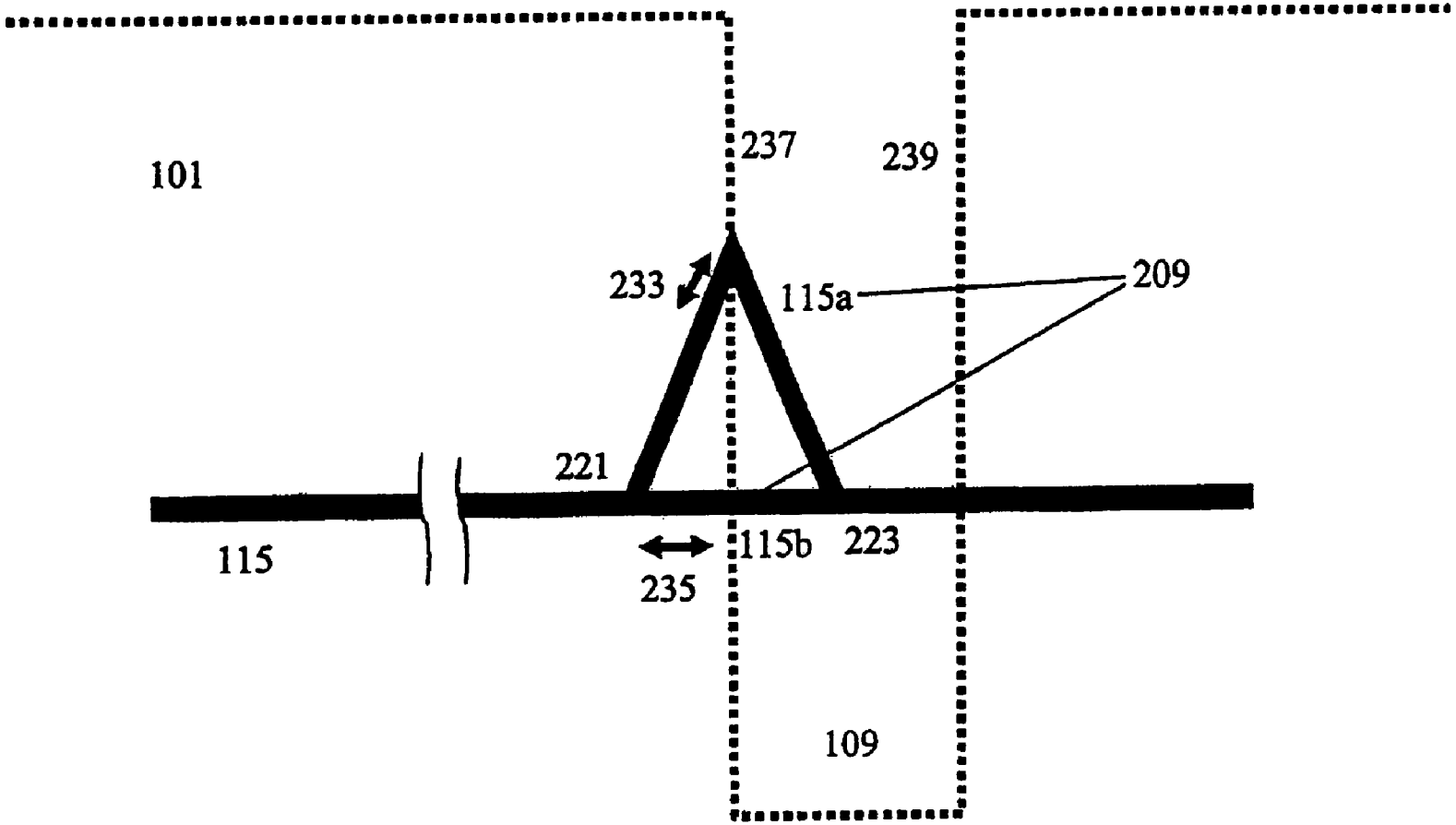
FIG. 5 is a schematic see-through view illustrating paths for high-frequency currents in a ground conductor of an embodiment of the variable slot antenna according to the present invention.

On the other hand, as shown in the upper schematic see-through view of FIG. 5, introduction of the loop line 209 into a variable slot antenna according to the present invention provides a unique effect which cannot be obtained in the aforementioned traditional high-frequency circuit. By replacing the linear-shaped feed line 115 with the loop line 209, near the portion of the ground conductor 101 where the slot region 109 exists, it becomes possible to fluctuate the local high-frequency current distribution around the slot region 109, thus changing the resonance characteristics of the slot antenna. The high-frequency currents in the ground conductor flow in a direction 233 along the first path 115*a* branching from the first branching point 221, and also flow in a direction 235 along the second path 115*b*. As a result, different paths 233 and 235 can be created in the flow of the high-frequency currents on the ground conductor, thus enabling the slot antenna to be excited at a plurality of places. Local changes in the high-frequency current distribution in the ground conductor near the slot drastically expand the operating band of the slot antenna.

Figure 6A:
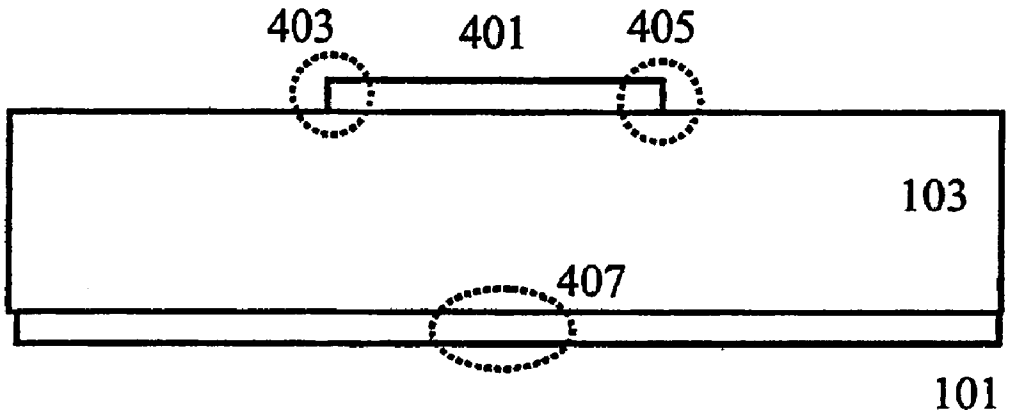
FIGS. 6A and 6B are cross-sectional structural diagrams illustrating places where high-frequency currents concentrate in a ground conductor of a transmission line.
Figure 6B:
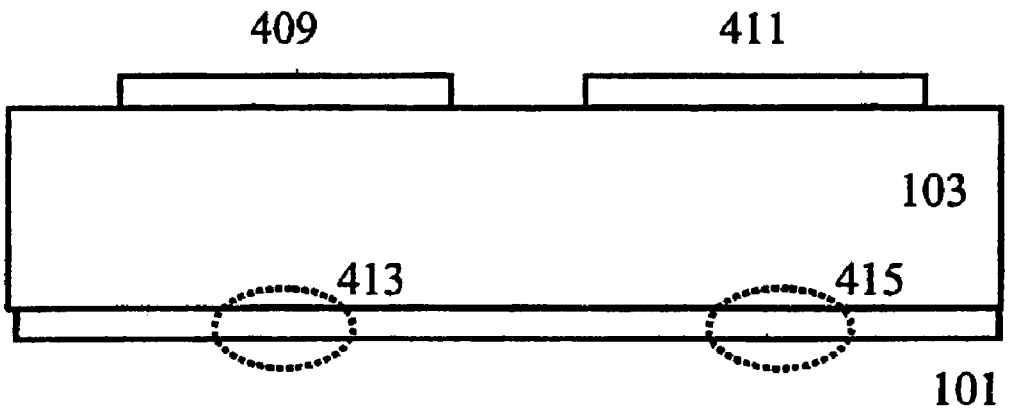

Generally speaking, during signal transmission, different high-frequency current distributions occur in the signal conductor side and the ground conductor side of the transmission line. Referring to FIGS. 6A and 6B, which show schematic diagrams of cross-sectional structures of transmission lines, it will be described how the intensity distributions of high-frequency currents at the signal conductor side and the ground conductor side may fluctuate as a result of branching the signal conductor. In the transmission line of FIG. 6A, the signal conductor is not branched. Therefore, it is at the edges 403 and 405 of a signal conductor 401 that a concentration of high-frequency currents occurs at the signal conductor side, and it is in a region 407 of the central portion opposing the signal conductor 401 that a concentration of high-frequency currents occurs at the ground conductor 101 side. Therefore, even if the width of the feed line 115 is increased in a conventional slot antenna, for example, no substantial changes can be caused in the distribution of the high-frequency currents at the ground conductor side, and thus it will be difficult to realize the same wideband effect as is attained by the variable slot antenna according to the present invention. However, as shown in FIG. 6B, which shows a schematic diagram of a cross-sectional structure of a transmission line in the case where the signal conductor 401 branches into two signal conductors 409 and 411, introduction of the branching structure unprecedentedly causes a distribution of high-frequency currents in each of different ground conductor regions 413 and 415 respectively opposing the branch lines 409 and 411.

Moreover, the loop line newly introduced in the variable slot antenna according to the present invention not only functions to increase the number of places where the slot antenna is excitable to more than one, but also functions to adjust the electrical length of the feed line 115. Fluctuations in the electrical length of the feed line due to the introduction of the loop line allows the feed line 115 to satisfy multiple resonance conditions, and further enhance the effect of expanding the operating band according to the present invention.

More specifically, as has already been described as conventional techniques with reference to FIGS. 25A to 25C and FIG. 27, the distance t3 from the leading open-end point to the place where it partially intersects the slot, or the value (t2+Ws÷2), has a close relationship with the effective wavelength at f0. The power-feeding structure for a variable slot antenna according to the present invention as shown in FIGS. 1A and 1B and FIGS. 3A and 3B not only conforms to the designing principle for the feed line in the respective slot antennas shown in FIGS. 25A to 25C and FIG. 27, but also expands its operating band.

Figures 25A, 25B, 25C:
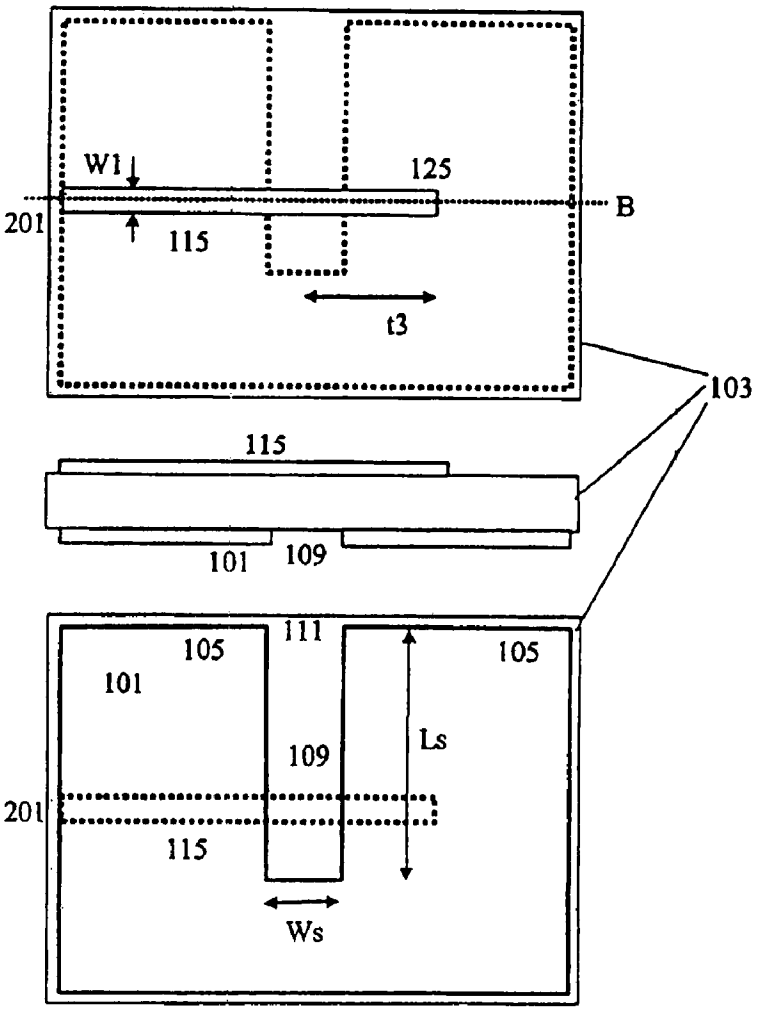
FIGS. 25A, 25B, and 25C are schematic structural diagrams of a traditional ¼ wavelength slot antenna.
Figure 26A:
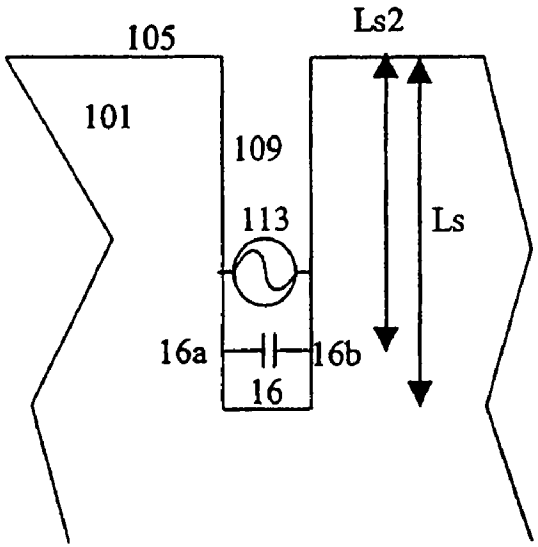
FIG. 26A is a schematic structural diagram of a ¼ wavelength slot antenna described in Patent Document 1.
Figure 26B:
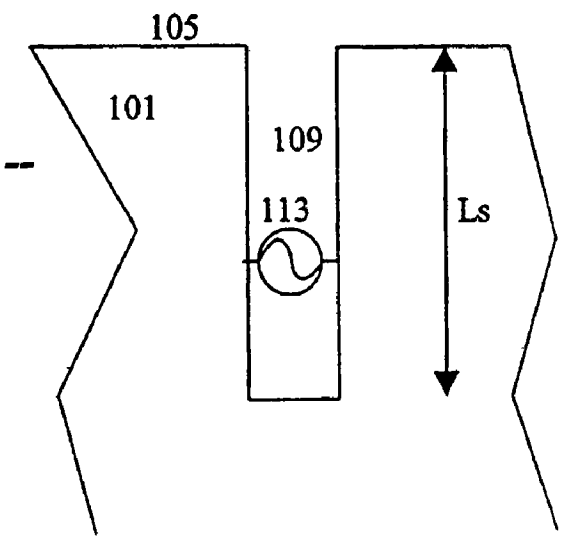
FIG. 26B is a schematic structural diagram of the slot antenna when operating in a low-frequency band.
Figure 26C:
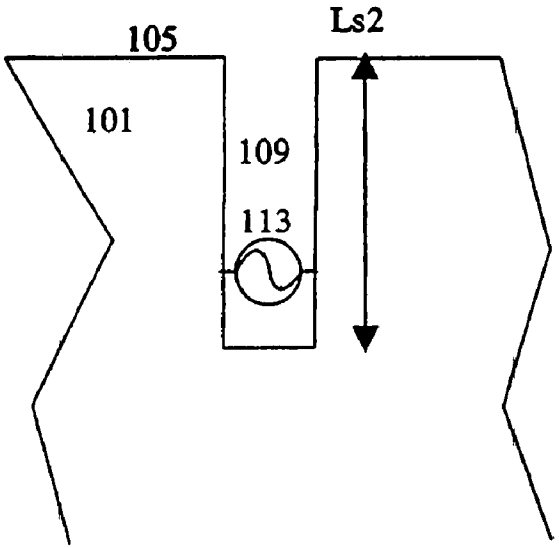
FIG. 26C is a schematic structural diagram of the slot antenna when operating in a high-frequency band.

In the traditional slot antenna shown in FIGS. 25A to 25C, in order to satisfy the input matching conditions at the resonant frequency of the slot, the slot length is to be designed in accordance with the operating frequency f0 of operation, and t3 is to be prescribed equal to a ¼ effective wavelength at f0. By introducing the loop structure of the present invention near the slot of the feed line 115, it is ensured that separate resonant frequencies of the feed line 115 are obtained, i.e., one for a path with the shorter electrical length and another for a path with the longer electrical length, among the two paths composing the loop line. Thus, a multiple resonance operation is realized.

Figure 27:
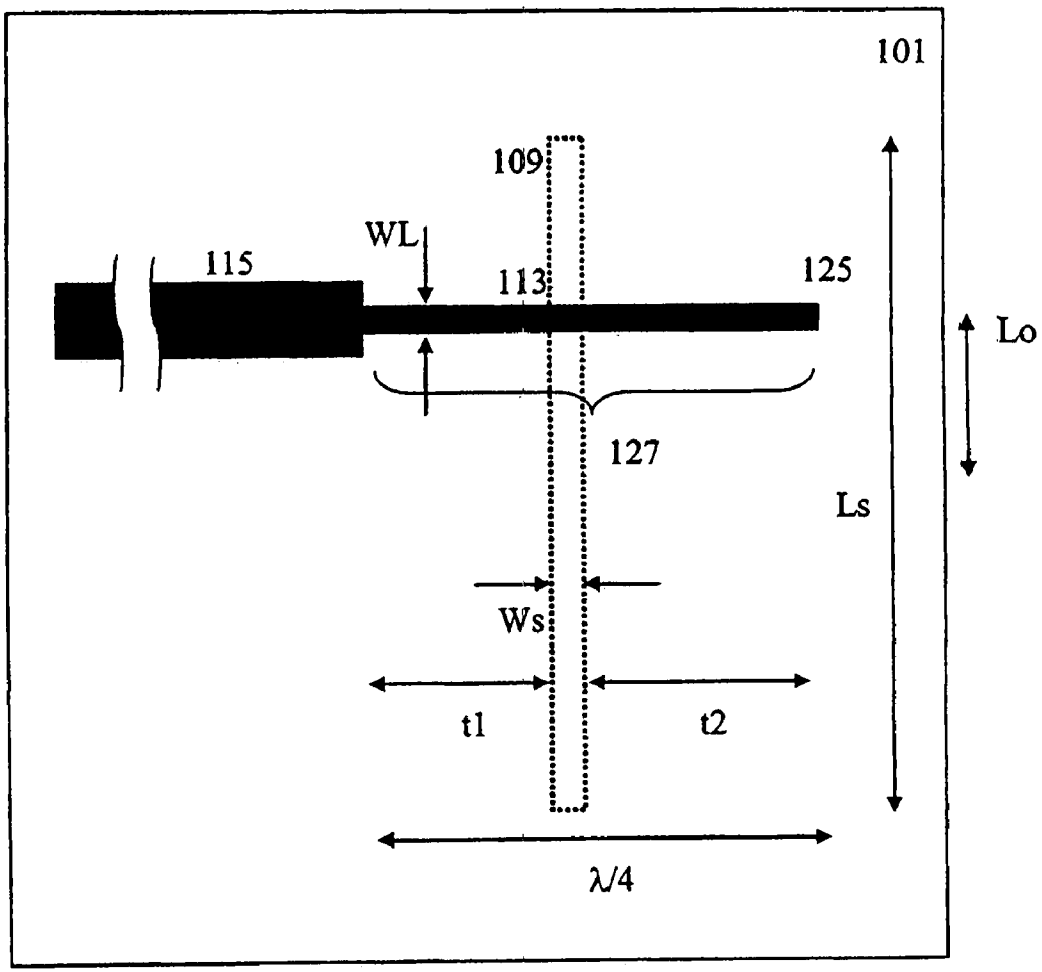
FIG. 27 is an upper schematic see-through view of a slot antenna structure described in Non-Patent Document 1.
Figure 28:
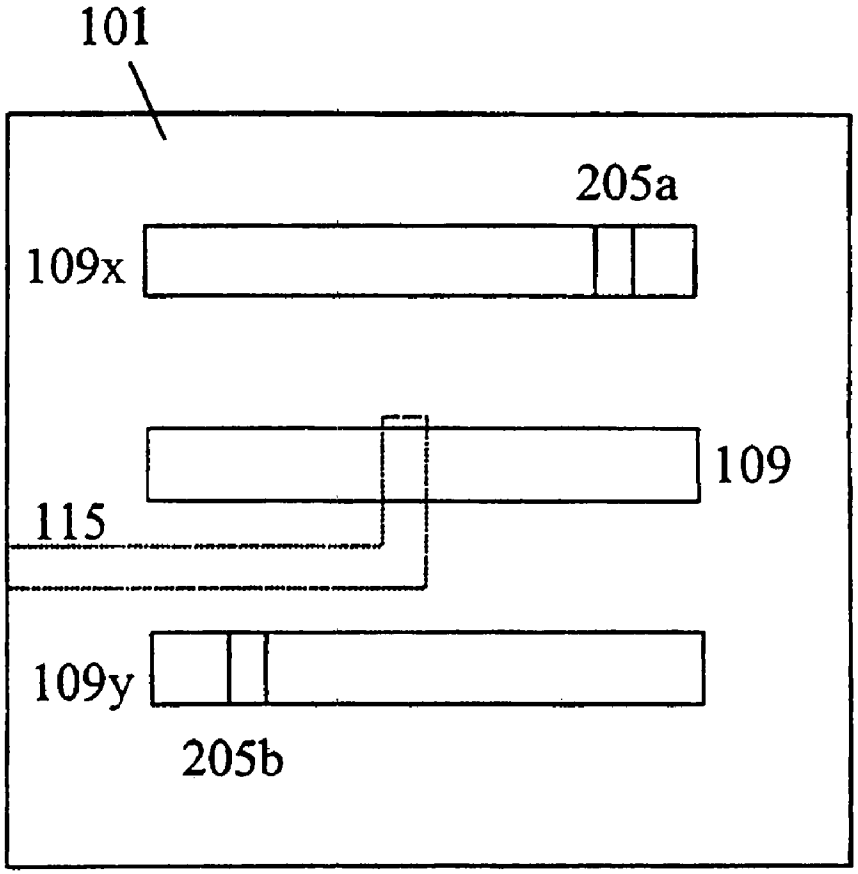
FIG. 28 is a structural diagram of a variable antenna disclosed in Patent Document 3.

Moreover, in the slot antenna shown in FIG. 27, the slot width Ws is prescribed to a large value, and the value t1+t2+Ws is prescribed equal to a ¼ effective wavelength at the f0. Moreover, the impedance of the transmission line in the ¼ effective wavelength region is prescribed at a high value, and the slot antenna is operated under the condition that t1 is approximately equal to t2. Since a resonator structure that newly couples to the slot resonator is introduced into the equivalent circuit, input matching is established at two resonant frequencies, whereby the slot antenna attains a wideband operation. By introducing the loop line of the present invention near the slot of such a feed line 115 structure, based on a difference in electrical length (i.e., the path with the shorter electrical length VS the path with the longer electrical length, among the two paths composing the loop line), it is ensured that a resonance phenomenon of coupling to the slot resonator occurs at a plurality of (two or more) frequencies. Thus, the matching condition which has already been wideband is made even more wideband.

To summarize the above discussion, in each operating state, a variable slot antenna according to the present invention is capable of operation in a wider band than that of a conventional slot antenna, based on the combination of a first function of enhancing the resonance phenomenon of the slot itself into multiple resonance and a second function of enhancing the resonance phenomenon of the feed line that couples to the slot into multiple resonance.

(Limitations on Loop Line)

However, the loop line in a variable slot antenna according to the present invention must be used under the conditions where the loop line will not undergo any unwanted resonation by itself, in order to maintain wideband matching characteristics. To take the loop line 209 of FIG. 4A for example, the loop length Lp, which is a sum of the path length Lp1 and the path length Lp2, must be prescribed so as to be shorter than the effective wavelength at the upper limit frequency fH in the operating band, even in the largest loop line within the structure.

A structure which is adopted in a traditional high-frequency circuit more frequently than is a loop line is an open stub shown in FIG. 4B. When the open stub 115*s* having a length Lp3 is connected in a branched form, the transmission line 211 satisfies a resonance condition at a frequency for which Lp3 equals a ¼ effective wavelength, thus exhibiting a band elimination filter function in the signal transmission between the input terminal 201 and the output terminal 203, which is an undesirable function for the variable slot antenna according to the present invention. Therefore, among the lines branching from the power-feeding structure of the variable slot antenna according to the present invention, any one that does not constitute a part of the loop line may take a stub structure. However, at the most, its stub length must be prescribed to be less than a ¼ effective wavelength at fH.

While comparing the extreme example of a loop line shown in FIG. 4C against the open stub structure shown in FIG. 4B, the advantages of a loop line will be described. In the loop line 209, as Lp2 is made extremely small, the loop line will apparently become infinitely closer to an open stub structure. However, the resonant frequency of the loop line in the case where Lp2 approximates zero is a frequency for which Lp1 equals 1×effective wavelength, and the resonant frequency of an open stub is a frequency for which Lp3 equals a ¼ effective wavelength. If the two structures are compared in terms of lowest-order resonant frequency under conditions where Lp1 is twice as large as Lp3, the resonant frequency of the loop line will prove to be twice the resonant frequency of the stub line. As can be seen from the above description, a loop line is twice as effective a structure, as an open stub, to be adopted for a feed line which must avoid any unwanted resonance phenomenon in a wide operating band, as quantitated in terms of frequency band. Moreover, since an open-end point 115*t* of the open stub of FIG. 4B is "open" in the circuitry, high-frequency currents will not flow therethrough; therefore, even if an open-end point 115*t* is provided near the slot, it will be difficult to excite the slot. On the other hand, a point 115*u* of the loop line 209 of FIG. 4C is not "open" in the circuitry, and therefore high-frequency currents are certain to flow therethrough. Thus, when provided near the slot, it will facilitate excitation of the slot. From this perspective, too, a loop line will be more advantageous than an open stub for obtaining the effects of the present invention.

Figure 7:
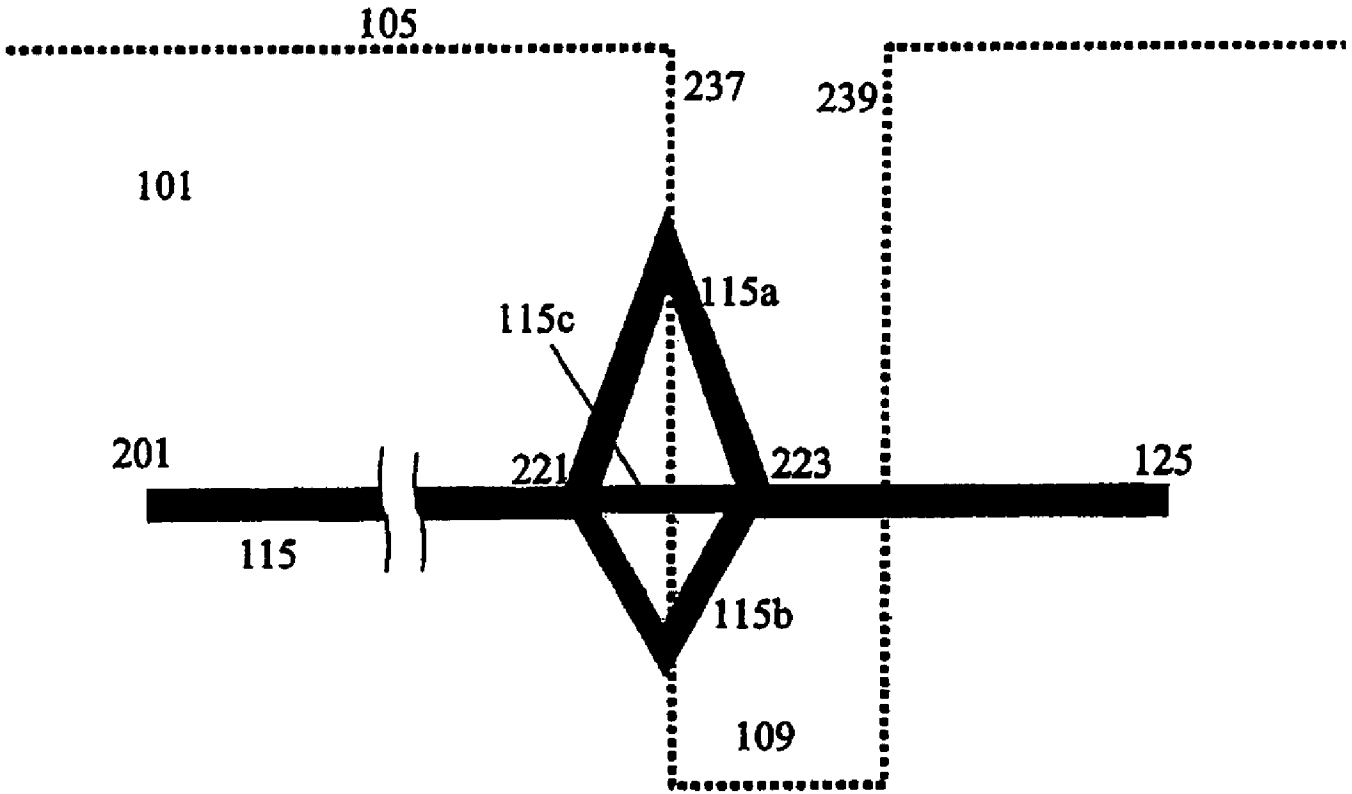
FIG. 7 is a schematic see-through view showing an exemplary power-feeding structure for a variable slot antenna according to the present invention.

The above description should make it clear that, by introducing a loop line in the feed line 115 of the variable slot antenna according to the present invention, instead of a line or an open stub having a thick line width, the limitations of the operating band are cleverly avoided, thereby effectively realizing a wide band operation. FIG. 7 is an upper schematic see-through view of an embodiment in which three branch lines extend from the feed line 115. Although the number of branch lines extending from the feed line 115 may be prescribed to be three or more, not as drastic an expansion of the operating band will be obtained as in the case where there are two branch lines. Within the group of branch lines including a plurality of branches, it is only a path 115*a* extending through a place closest to the open end of the slot and a path 115*b* extending through a place farthest from the open end of the slot that has a high distribution intensity of high-frequency current, and therefore the high-frequency current flowing through a path 115 lying therebetween is not very intense. On the other hand, in the case where there are two branches lines, the loop length of the loop line formed by the path 115*a* and the path 115*b* may become longer than intended, thus resulting in a drop in the resonant frequency of the loop line. This may act as a limitation on the improvement of the upper limit frequency fH of the operating band of the variable slot antenna according to the present invention. However, adding the path 115*c* will allow the loop line to be divided up, which is effective for the relaxation of such a limitation.

As for the relative positions of the loop line and the slot region, as shown already in the upper schematic see-through view of FIG. 5, it is preferable that the first path 115*a* and the second path 115*b* composing the loop line each intersect at least either one of border lines 237 and 239 between the slot region 109 and the ground conductor 101.

Figure 8:
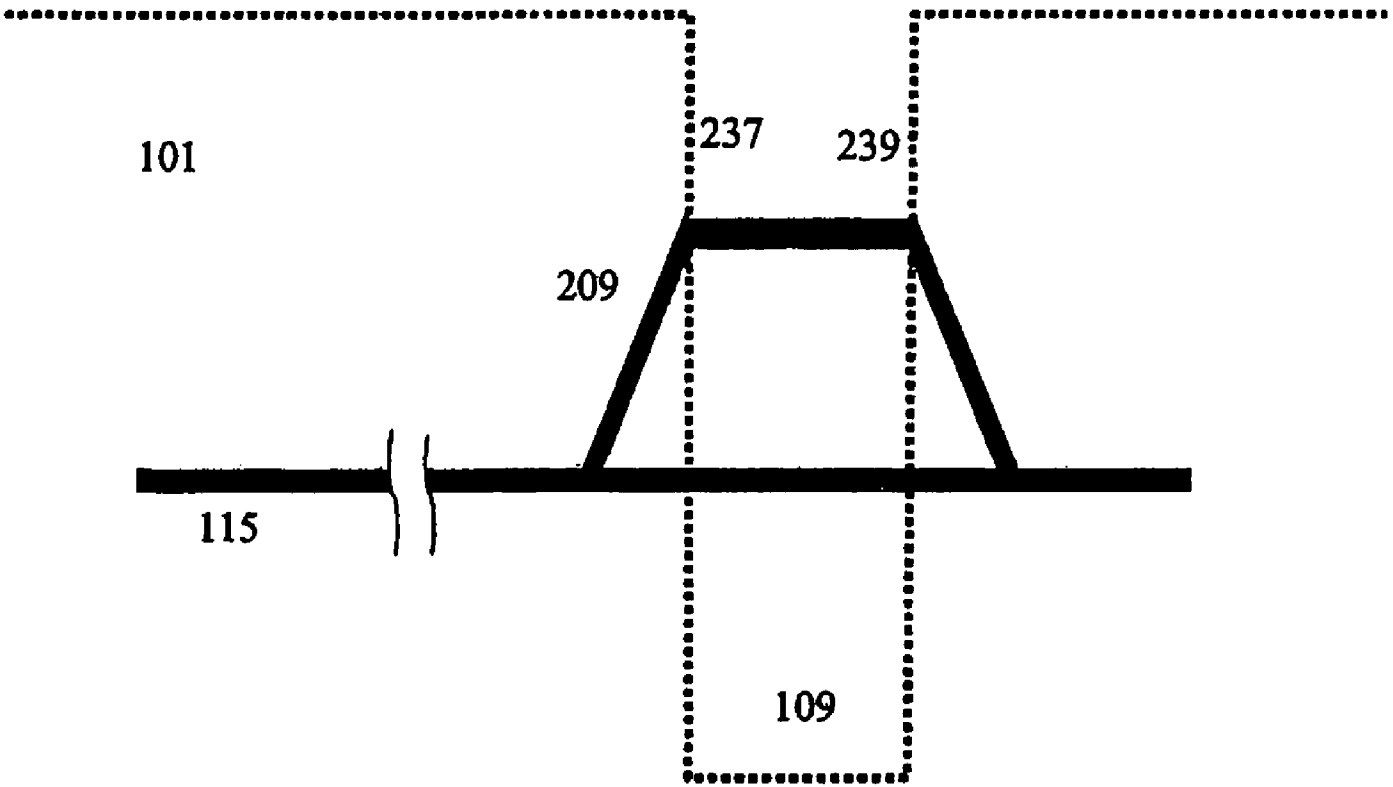
FIG. 8 is a schematic see-through view showing an exemplary power-feeding structure for a variable slot antenna according to the present invention.
Figure 9:
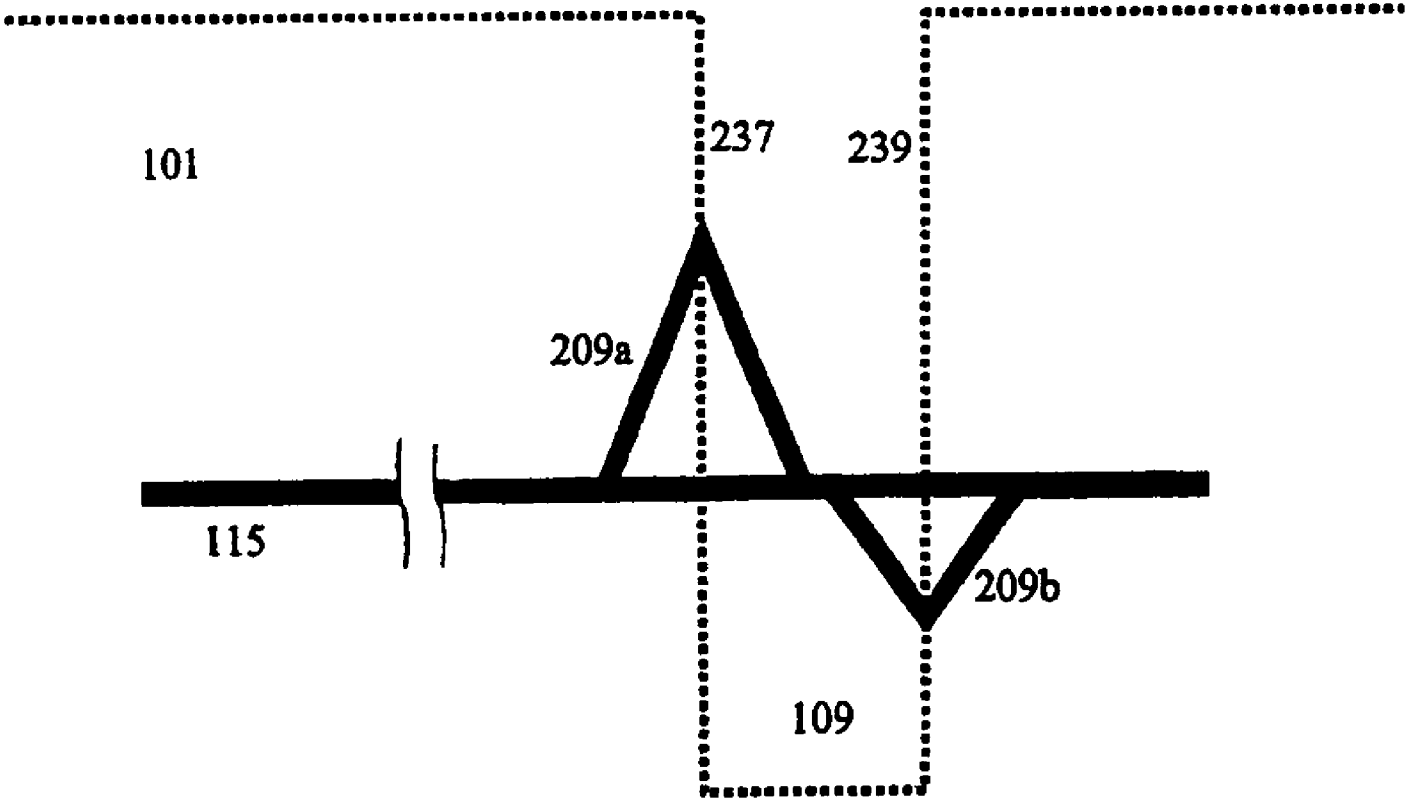
FIG. 9 is a schematic see-through view showing an exemplary power-feeding structure for a variable slot antenna according to the present invention.
Figure 10:
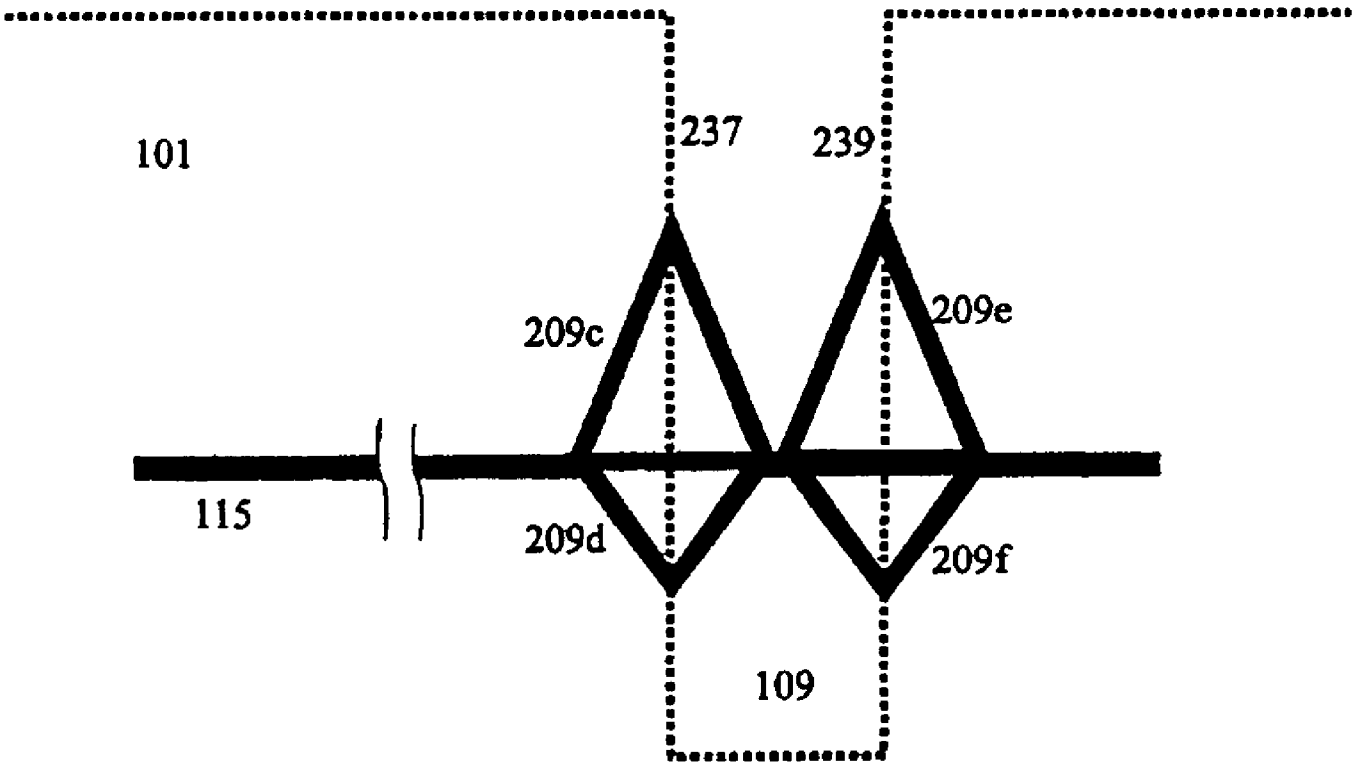
FIG. 10 is a schematic see-through view showing an exemplary power-feeding structure for a variable slot antenna according to the present invention.

As illustrated in the upper schematic see-through view of FIG. 8 showing another example, the loop line 209 may be designed so as to intersect both border lines 237 and 239. As can be seen from FIG. 8 exemplifying the loop line 209 to be in a trapezoidal shape, there are no particular limitations as to the shape of the loop line. A plurality of loop lines 209 may be formed. In the case where a plurality of loop lines 209 are formed, such loop lines 209 may be connected in series as already shown in FIGS. 1A and 1B, or connected in parallel as already shown in FIG. 7. Two loop lines may be directly interconnected, or indirectly connected via a transmission line of an arbitrary shape. As illustrated in the upper schematic see-through view of FIG. 9 showing still another example, two loop lines 209*a* and 209*b* which respectively intersect the border lines 237 and 239 may be provided in series. Furthermore, as shown in the upper schematic see-through view of FIG. 10, parallel-connected loop lines 209*c* and 209*d* each intersecting a border line 237 and parallel-connected loop lines 209*e* and 209*f* each intersecting a border line 239 may be provided in series.

It may be possible to place the frequency at which the ground conductor 101 (having a finite area) of the variable slot antenna according to the present invention resonates so as to be close to the operating band of the variable slot antenna according to the present invention, thus obtaining a further wideband-ness and multiband characteristics. In other words, by prescribing the frequency at which the ground conductor itself resonates like a patch antenna, a monopole antenna, or a dipole antenna and provides radiation characteristics to be a frequency which is lower than the resonant band of the variable slot antenna according to the present invention, a further expansion of the input matching band can be realized.

Note that the line width of the loop line 209 is preferably selected so that, equivalently, the same condition as the characteristic impedance of the feed line 115 which is connected to the input side or the leading open-end is obtained, or an even higher impedance is obtained. Specifically, in the case where the feed line 115 is branched into two portions, it is preferable that the loop line consists of branch lines each having a line width which is half of that of the unbranched feed line 115. As is also clear from Non-Patent Document 1, the slot antenna itself tends to facilitate matching with the resistance value 50Ω of the input terminal due to coupling with the high-impedance line. Therefore, for realizing even lower-return characteristics, it is effective to, equivalently, increase the characteristic impedance of the feed line 115 near the slot region 109 by introducing the loop line portion.

With the above construction, it becomes possible to expand the operating band of an antenna which utilizes a ¼ effective wavelength slot resonator. The main beam direction of electromagnetic waves which are emitted from the ¼ effective wavelength slot antenna is the direction of an open end of the slot region 109 as viewed from the feeding site 113, this main beam direction being maintained constant within the expanded operating band. Next, it will be described how the function of globally switching the main beam direction in a drastic manner is exhibited.

(Features of the Driving Method)

In a variable slot antenna according to the present invention, in order to drastically switch the main beam direction, either one of the first selective conduction path 119 and the second selective conduction path 121 is allowed to conduct, while the other selective conduction path is always selected to be open. In this case, the main beam can be oriented in the direction of the open selective conduction path as viewed from the feeding site 113. Thus, by switching the selective conduction path to conduct and the selective conduction path to be open, it becomes possible to switch the main beam direction into different directions.

For example, in order to direct the main beam in the right direction 123*a* (FIG. 1A), the second selective conduction path 121 placed on the right side of the feeding site 113 may be opened and the first selective conduction path 119 placed on the opposite side, i.e., left side, of the feeding site 113 may be short-circuited. Conversely, in order to direct the main beam in the left direction 123*b* (FIG. 1B), the first selective conduction path 119 placed on the left side of the feeding site 113 may be opened and the second selective conduction path 121 placed on the right side of the feeding site 113 may be short-circuited. Table 1 summarizes, according to the present driving method, how each selective conduction path should be controlled in order to direct the main beam toward the right or left.

TABLE 1

| main beam direction | corresponding FIG. | selective conduction path first (left) | selective conduction path second (right) |
|---|---|---|---|
| right | 1A | conducting | open |
| left | 1B | open | conducting |

Figure 11B:
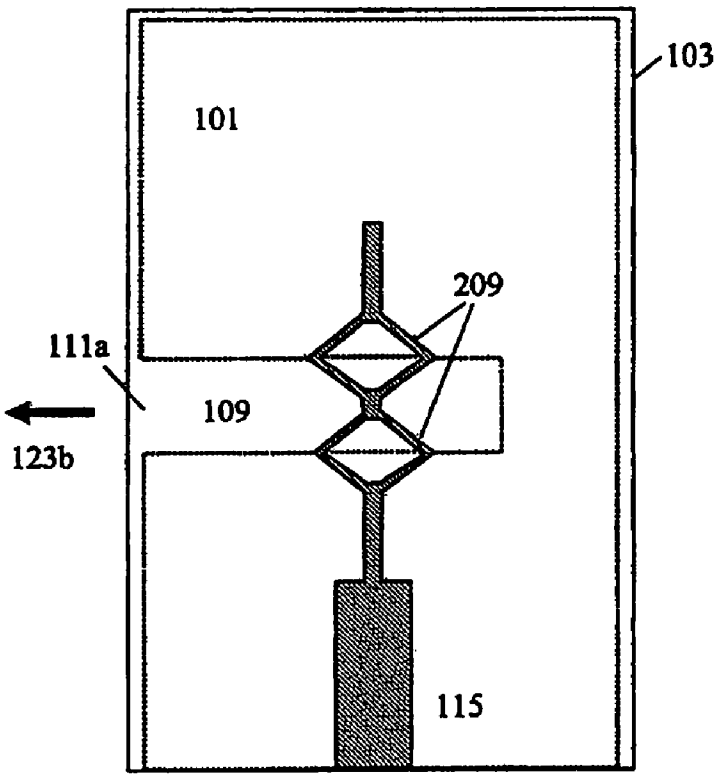
FIGS. 11A and 11B are schematic diagrams of structures which are realized on a variable slot antenna according to the present invention in high-frequency terms.
Figure 11A:
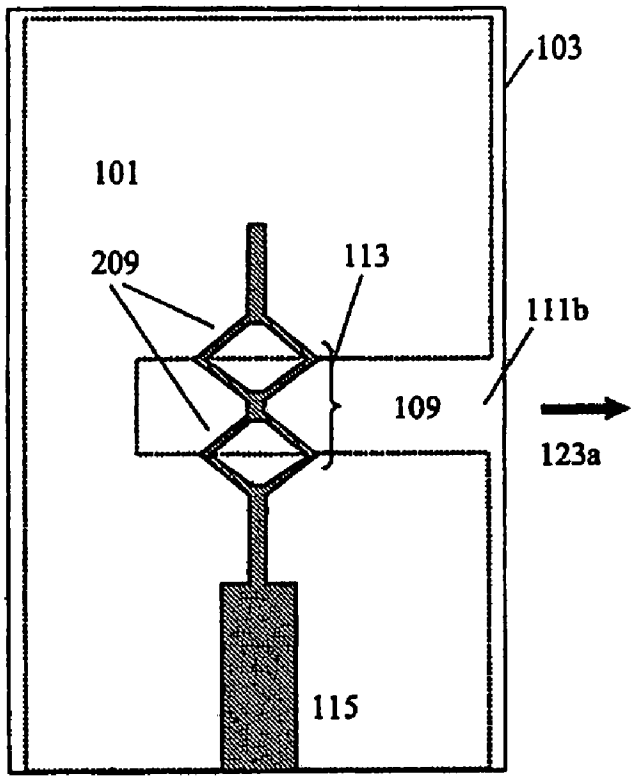

In the variable slot antenna according to the present invention, in each driving state, a ¼ effective wavelength slot resonator which is opened on one end and short-circuited on the other appears in high-frequency terms within the structure, as each conducting selective conduction path locally connects between the split ground conductors 101*a* and 101*b*. FIGS. 11A and 11B schematically show structures which are realized in high-frequency terms on the variable slot antenna being driven into the states of FIGS. 1A and 1B, respectively. As described above, both ends of the slot region of the variable slot antenna according to the present invention are initially designed as open ends, but in each driving state, one end can be regarded as being short-circuited in high-frequency terms. For example, in FIG. 11A, the open end 111*a* (which is illustrated in FIG. 1A) is omitted from illustration. This is because, when the first selective conduction path 119 disposed in the direction of the open end 111*a* as viewed from the feeding site 113 is controlled to conduct, the open end 111*a* as viewed from the feeding site 113 becomes ignorable in high-frequency terms. Moreover, when the second selective conduction path 121 is in an open state in high-frequency terms, only a very limited influence of the specific shape, etc., of the second selective conduction path 121 is exerted on the radiation characteristics, so that FIG. 1A can be approximated in high-frequency terms as shown in FIG. 11A. Similarly, the variable slot antenna in the driving state of FIG. 1B can be approximated in high-frequency terms as shown in FIG. 11B.

The main beam direction obtained when feeding the ¼ effective wavelength slot resonator is a direction of an open end from the feeding site. Therefore, the variable slot antenna according to the present invention is able to realize a drastic switching of the main beam direction, because the direction of an open end as viewed from the feeding site can be switched based on the driving state. Note that in each of the diagrams shown in FIGS. 5, 7 to 10 above, a structure which is realized in high-frequency terms by the variable slot antenna in an arbitrary driving state is schematically shown, where the selective conduction paths are omitted from illustration.

Figure 12:
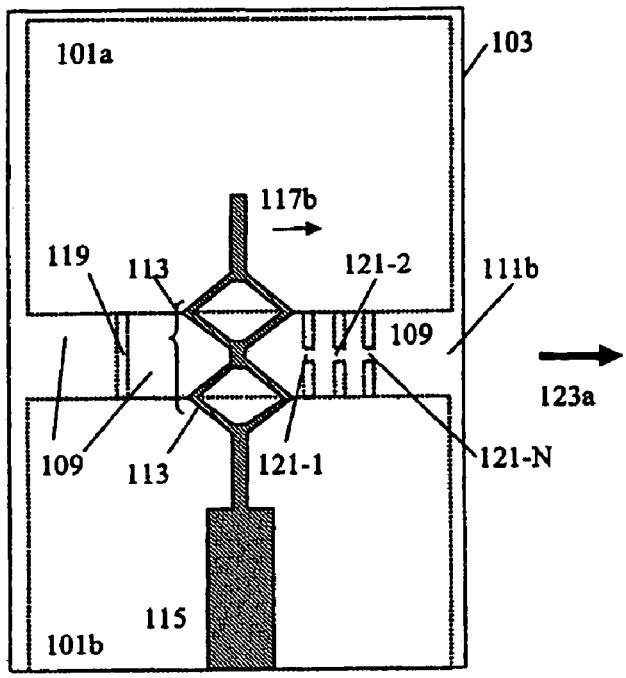
FIG. 12 is a schematic see-through view of a variable slot antenna according to the present invention.
Figure 13:
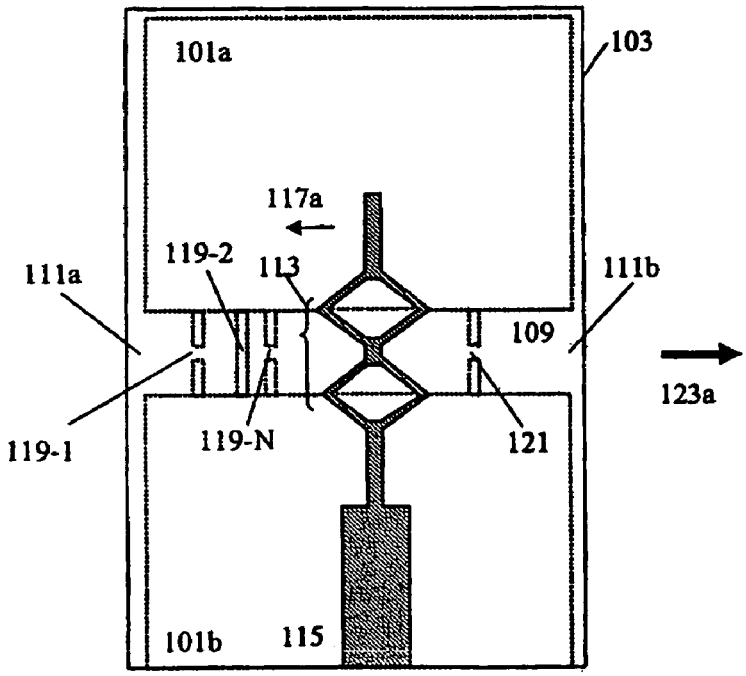
FIG. 13 is a schematic see-through view of a variable slot antenna according to the present invention.

According to the above principles, as shown in FIG. 12 and FIG. 13, when a plurality of selective conduction paths (rather than one selective conduction path) are disposed toward an open end 111*a* or 111*b* of the slot region 109 as viewed from the feeding site 113 in a variable slot antenna which is driven by the driving method according to the present invention, the driving method becomes more limited. First, as shown in FIG. 12, when it is desired to direct the main beam toward the right (i.e., the direction of arrow 123*a*), if a plurality of second selective conduction paths 121-1, 121-2, . . . , and 121-N are provided in the direction of the open end 111*b* as viewed from the feeding site 113 (i.e., the direction 117*b*), then all of the second selective conduction paths 121-1, 121-2, . . . , and 121-N are controlled to be open. On the other hand, as shown in FIG. 13, when it is desired to direct the main beam toward the right (direction of arrow 123*a*), if a plurality of first selective conduction paths 119-1, 119-2, . . . , and 119-N are provided in the direction of the open end 111*a* as viewed from the feeding site 113 (i.e., the direction 117*a*), then at least one of the first selective conduction paths 119-1, 119-2, . . . , and 119-N may be controlled to conduct. FIG. 13 shows a state where only the second selective conduction path 119-2 is controlled to conduct. Based on the selection of the conducting selective conduction path, it becomes possible to adjust the resonator length of the resultant slot resonator. Moreover, selection of the conducting selective conduction path also makes it possible to adjust the feeding impedance for the slot resonator. It will be appreciated that all of the selective conduction paths may be allowed to conduct.

(Selective Conduction Paths)

Figure 14B:
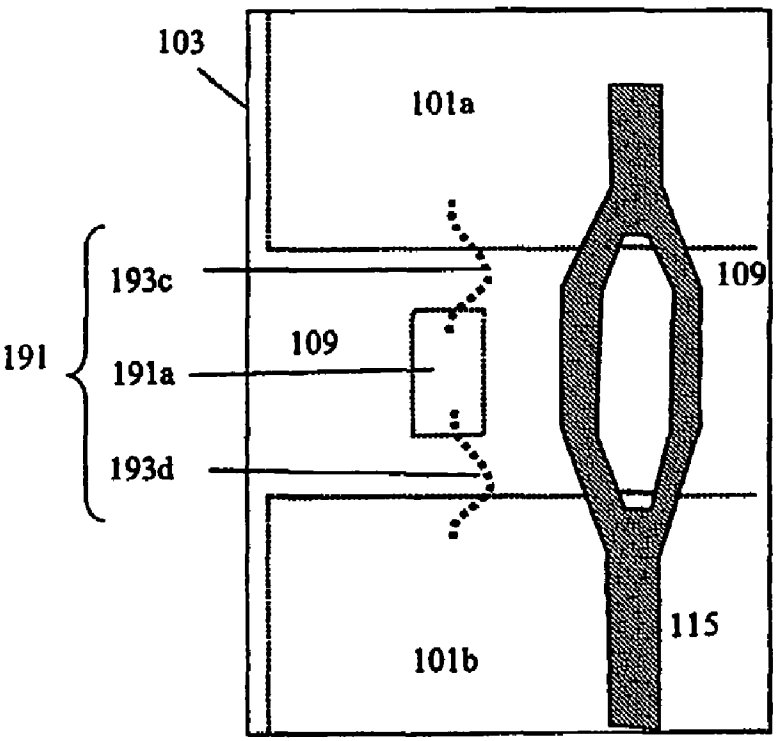
FIGS. 14A and 14B are enlarged views near a selective conduction path according to the present invention.
Figure 14A:
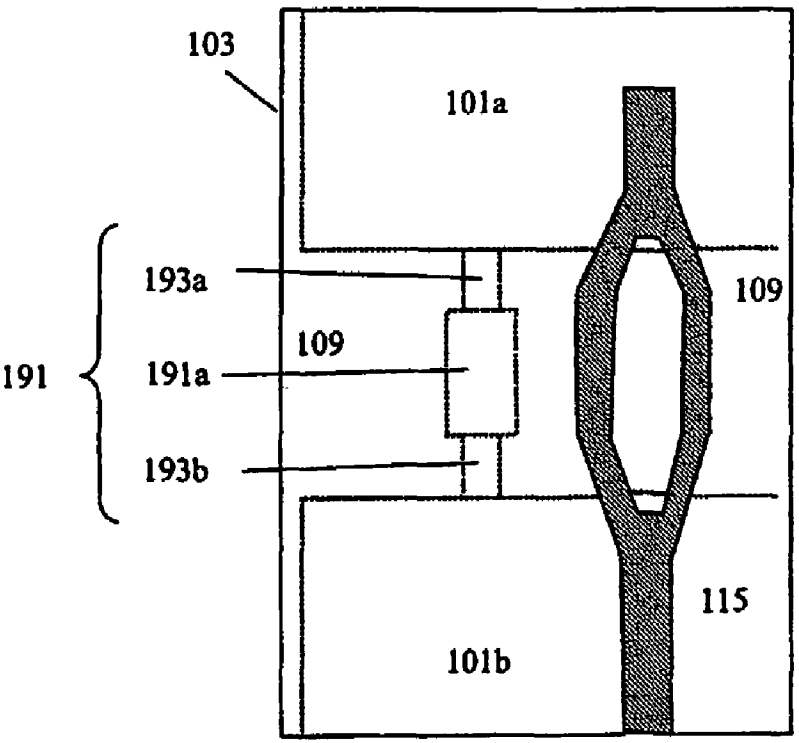
Figure 15:
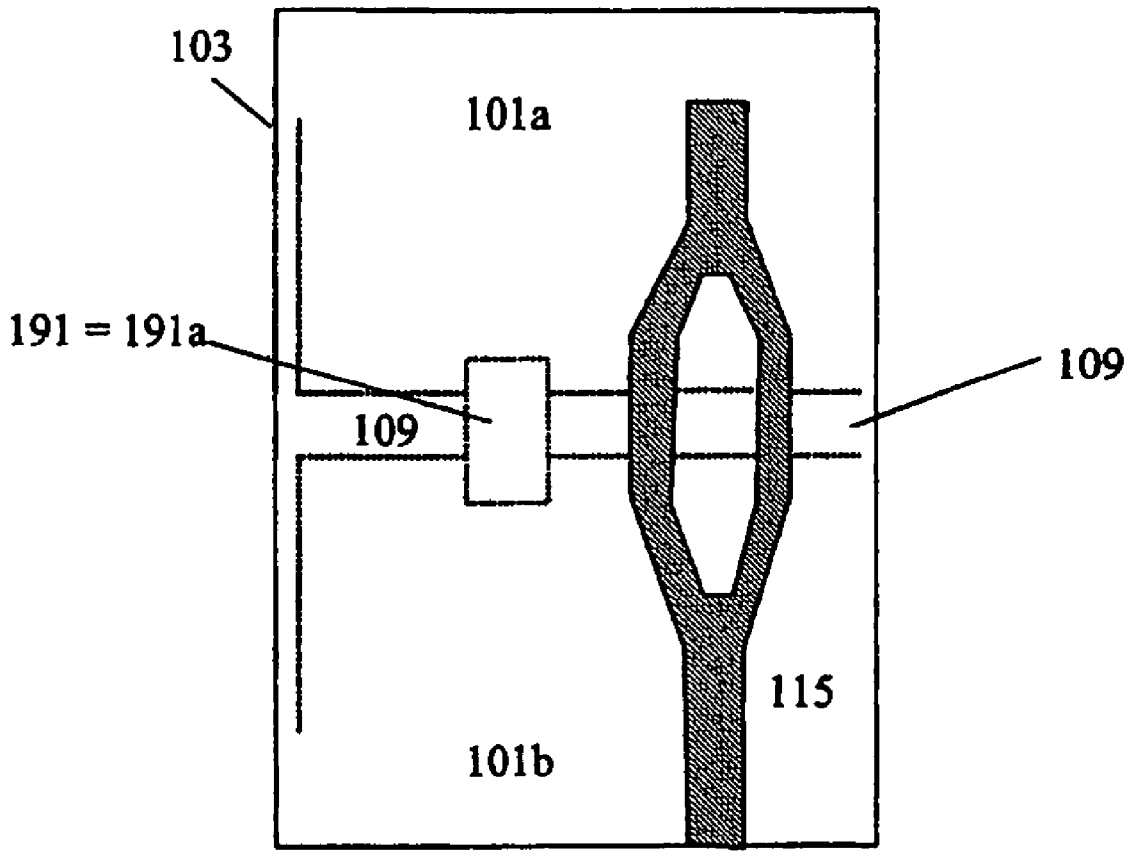
FIG. 15 is an enlarged view near a selective conduction path according to the present invention.

The conduction between the first ground conductor 101*a* and the second ground conductor 101*b* which is realized by the first and second selective conduction paths does not need to be conduction in terms of DC signals, but may merely be conduction in high-frequency terms such that the passband is limited to near the operating frequency. Specifically, in order to implement the selective conduction paths according to the present invention, any switching elements that provide low-loss and high-separation characteristics in the antenna operating band may be used, e.g., diode switches, high-frequency transistors, high-frequency switches, or MEMS switches. Using diode switches will simplify the construction of the feed circuit. Specifically, by ensuring that the diode switches inserted in the first selective conduction path and the second selective conduction path are in opposite polarities, and by grounding either the ground conductor 101*a* or 101*b* in DC terms and controlling the voltage applied to the other ground conductor, switching between the first driving state and the second driving state can be easily realized. FIGS. 14A and 14B are schematic diagrams showing exemplary implementations of selective conduction paths for use in the present invention (with the neighboring lower face structure being shown enlarged), especially with respect to the case where the width of the slot region 109 is wider than the size of the switching element. As shown in FIG. 14A, the selective conduction path 191 may be composed of: a switching element 191*a* capable of switching between conducting and open states of a high-frequency signal; and conductors 193*a* and 193*b* in the form of projections on both sides of the switching element 191*a*. The conductors 193*a* and 193*b* are shaped so as to project into the slot region 109 from the ground conductors 101*a* and 101*b*, respectively. One of the conductors 193*a* and 193*b* may be omitted from the structure so that the switching element 191*a* is directly connected to either ground conductor 101*a* or 101*b*. Alternatively, as shown in FIG. 14B, instead of conductors 193*a* and 193*b*, conductor wires 193*c* and 193*d* may be used to provide connection between the ground conductor 101*a* and the switching element 191*a* and between the ground conductor 101*b* and the switching element 191*a*. On the other hand, FIG. 15 shows an exemplary implementation of the selective conduction path 191 (as an enlarged view of the neighborhood of only a selective conduction path) in the case where the size of the switching element 191*a* is larger than the width of the slot region 109. In either case, the selective conduction path is a structure which is formed so as to straddle the slot region in a manner of connecting between the ground conductors 101*a* and 101*b*, with a switching element being inserted in series within the path, such the switching element is capable of controlling the two states of conducting or open in high-frequency terms. When the switching element in the path is opened, the selective conduction path functions in an open state in high-frequency terms. When the switching element in the path is controlled to conduct, the selective conduction path functions in a conducting state in high-frequency terms. Since any switching element that is used in a high-frequency band will have a parasitic circuit component depending on its structure, strictly speaking, it is impossible to realize a completely-open state or a completely-conducting state. By designing the circuitry while taking the parasitic circuit components into consideration, the objective of the present invention can be easily attained. For example, commercially-available gallium arsenide PIN diode switches, which are used in the Examples of the present invention, have a series parasitic capacitance of 0.05 pF, and thus make it possible to obtain separation characteristics that are sufficient for the purpose of the present invention, e.g., about 25 dB in the 5 GHz band in an open state. Even if the variable slot antenna according to the present invention is designed without taking this value into consideration, there will be no large change in the characteristics. Moreover, the aforementioned commercially-available diode switches have a series parasitic resistance of 4Ω, thus resulting in a loss value of about 0.3 dB in the 5 GHz band in a conducting state, and providing low-loss characteristics which are sufficient for the purpose of the present invention. Thus, even if the variable slot antenna according to the present invention is driven while ignoring this value, as if an ideal switching element were installed, it would be possible to ignore deterioration in characteristics such as radiation efficiency of the antenna. Thus, the selective conduction paths to be used in the present invention can be easily implemented by traditional circuit technology.

(Orientation of Slot Region)

The main beam direction of a variable slot antenna according to the present invention can be changed depending on the direction in which the slot is formed. That is, by orienting the direction of an open end of the slot as viewed from the feeding so as to be slightly downward, the main beam direction of the emitted electromagnetic waves can also be oriented slightly downward.

(Symmetry of Construction)

The shape of a variable slot antenna according to the present invention does not need to be mirror symmetrical. However, it may be of an especially high industrial value to provide an antenna which has the switchability of switching the main beam direction alone while maintaining the same return characteristics, same gain characteristics, and same polarization characteristics between two states. Therefore, it is preferable that the shape of the slot region 109, the shapes of the feed line 115 and the loop line 209, and the shapes of the ground conductors 101*a* and 101*b* are mirror symmetrical.

(Slot Resonator)

Regarding the slot resonator which appears on the circuit in each driving state, when the slot width Ws (i.e., the distance between the first ground conductor 101*a* and the second ground conductor 101*b*) is negligibly narrow relative to the slot resonator length Ls (i.e., generally when Ws is (Ls/8) or less), the slot length Ls is prescribed equal to a ¼ effective wavelength near the center frequency f0 of the operating band. In the case where the slot width Ws is wide and non-negligible relative to the slot resonator length Ls (i.e., generally when Ws exceeds (Ls/8)), a slot length which takes the slot width into consideration (Ls×2+Ws) may be prescribed equal to a ½ effective wavelength at f0.

The slot resonator length Ls is defined as a distance from a conducting selective conduction path (119 or 121), astride the feed line 115 and the feeding site 113, to an opening 111. Note that, in the case where more than one selective conduction path is provided on either side, as shown in FIG. 12, Ls is defined as a distance from a switch 121 that is the closest to the feed line 115, astride the feed line 115 and the feeding site 113, to the opening 111, strictly speaking.

(Examples of Other Shapes for Slots)

Figure 16:
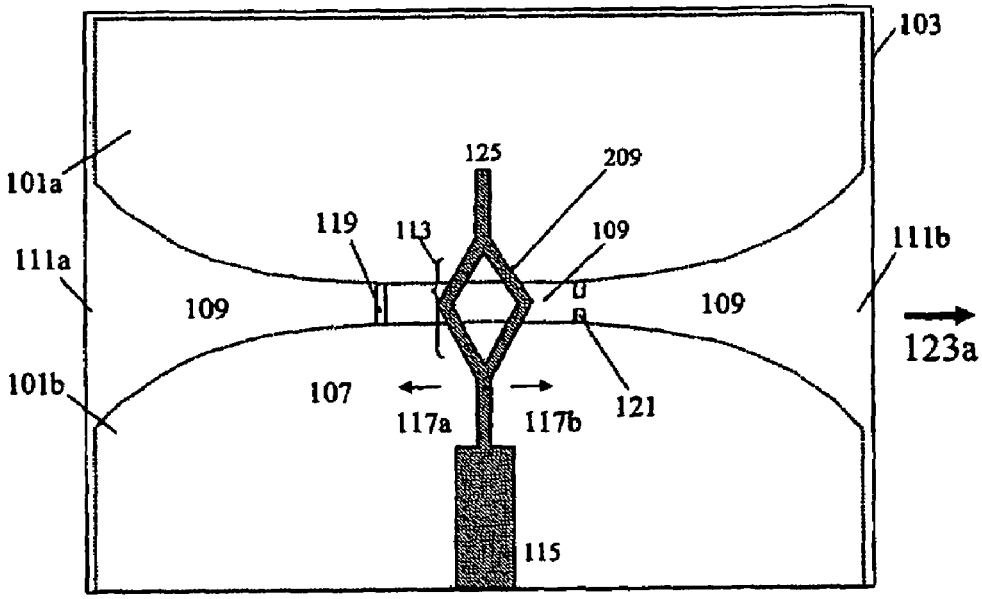
FIG. 16 is a schematic see-through view of a variable slot antenna according to the present invention.

In the variable slot antenna according to the present invention, the shape of the slot region does not need to be rectangular, but each border line with a ground conductor region may be replaced with any arbitrary linear or curved shape. For example, as shown in FIG. 16, the shape of the slot region may be configured so that the slot width has a tapered increase near each open end. Near an upper limit frequency of the operating band, the beam width is determined by a radiation aperture plane of the antenna. Therefore, increasing the slot width near each open end makes it easier to realize a high-gain directive beam.

Figure 17:
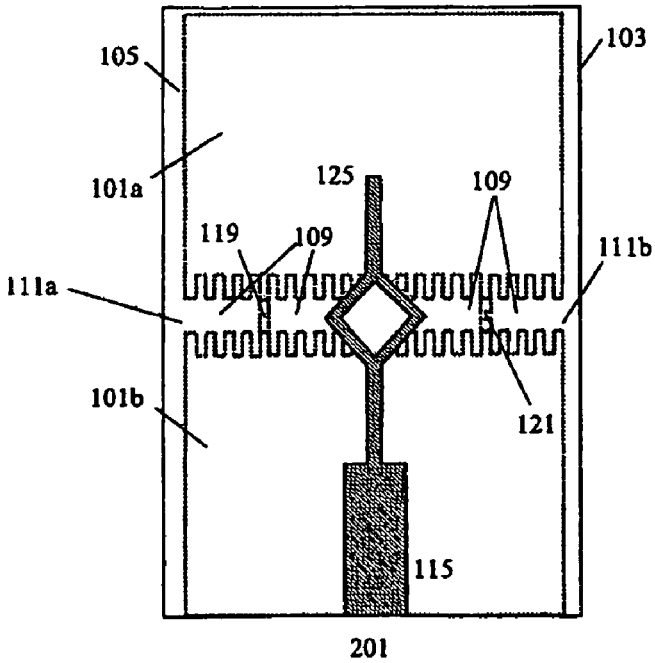
FIG. 17 is a schematic see-through view of a variable slot antenna according to the present invention.

Alternatively, as shown in FIG. 17, a multitude of thin and short slots may be connected in parallel to the main slot region (i.e., small contiguous protrusions and depressions may be provided on one opposing side of the four sides of each of the first ground conductor 101*a* and the second ground conductor 101*b*, which are generally rectangular). This results in an effect of adding a series inductance to the main slot region, thus providing the practically preferable effects of realizing an effective reduction in slot length and a downsizing of the circuitry. Further alternatively, also with a variable slot antenna structure in which the main slot region is given a narrow slot width and folded into a meandering shape or the like for downsizing, the main beam direction switching effect by the driving method according to the present invention can be obtained.

(Treatment of Feed Line Open End and Multiple Resonance Structure)

The end point 125 of the feed line 115 may be grounded via a resistor to obtain wideband matching characteristics. Similarly, the line width of the feed line 115 may be gradually increased near the end point 125, so as to result in a radial end shape, thus to obtain wideband matching characteristics.

Moreover, an additional dielectric 129 may be loaded at the open end 111*a* or 111*b*, for example, thus changing the radiation characteristics of the slot antenna. Specifically, the main beam half-width characteristics during wideband operation or the like can be controlled.

(Multilayer Structure Embodiments)

Figure 18A:
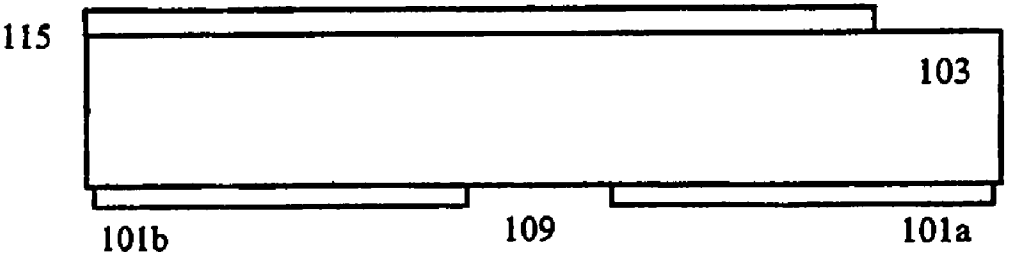
FIG. 18 is a cross-sectional structural diagram of a variable slot antenna according to the present invention.
Figure 18B:
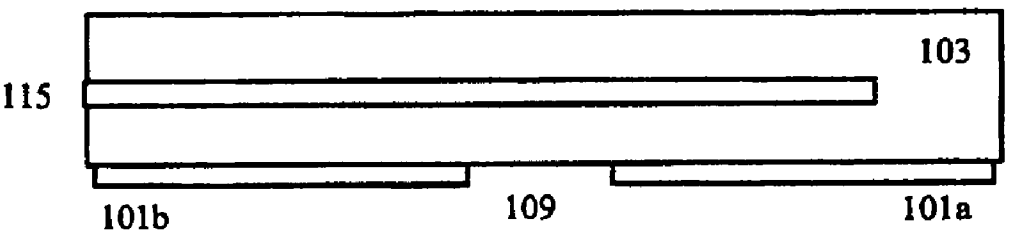
Figure 18C:
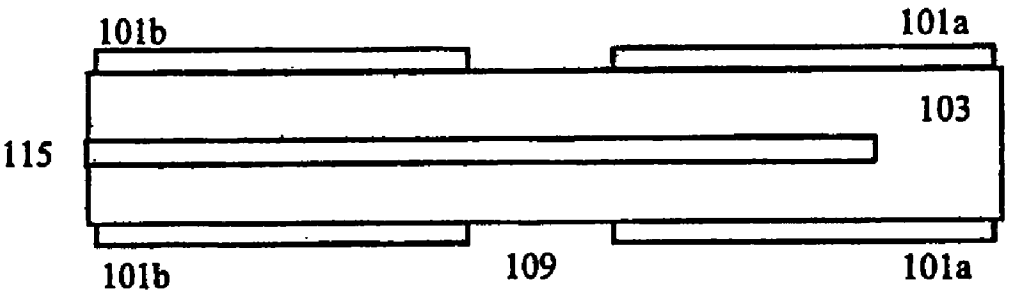

The present specification has illustrated a structure, as shown in the cross-sectional view of FIG. 18A, in which the feed line 115 is disposed on the frontmost face of the dielectric substrate 103 and the ground conductor 101 is disposed on the rearmost face of the dielectric substrate 103. However, as illustrated in FIG. 18B showing a cross-sectional view of another embodiment, by methods such as adopting a multilayer substrate, either or both of the feed line 115 and the ground conductor 101 may be disposed at an inner layer plane of the dielectric substrate 103. Moreover, it is not a limitation that there is one conductor wiring surface functioning as a ground conductor 101 for the feed line 115 within the structure. As illustrated in FIG. 18C showing a cross-sectional view of another embodiment, a structure may be adopted in which opposing ground conductors 101 sandwich a layer in which the feed line 115 is formed. In other words, the driving method for the variable slot antenna according to the present invention can provide similar effects in the case of a variable slot antenna having a strip line structure, as well as a variable slot antenna having the microstrip line structure.

EXAMPLES

Figure 19:
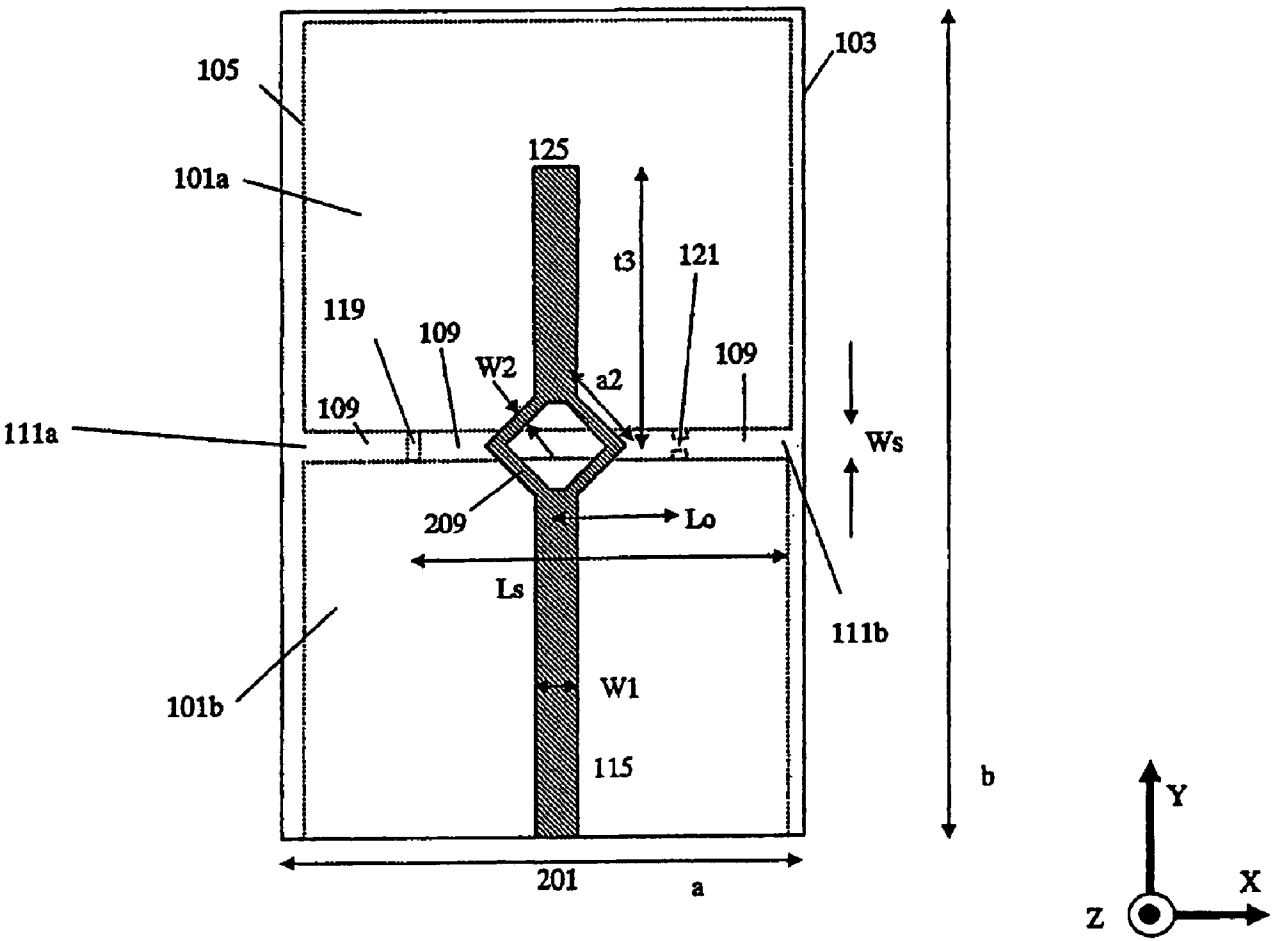
FIG. 19 is a structural diagram of a variable antenna according to Example 1.

A variable slot antenna of Example 1, as shown in a schematic see-through view (through an upper face) of FIG. 19, was produced. As a dielectric substrate 103, an FR4 substrate having an overall thickness of 0.5 mm was used. On the front face and the rear face of the substrate, respectively, a feed line pattern and a ground conductor pattern each having a thickness of 20 microns were formed, by using a copper line. Each wiring pattern was formed by removing some regions of the metal layer through wet etching, and gold plating was provided on the surface to a thickness of 1 micron. The wiring margin was set so that, even at the closest points to the end faces of the dielectric substrate 101, an outer edge 105 of the ground conductor 101 remained inside the dielectric substrate 103 by no less than 0.1 mm from the end faces. In the figure, the ground conductor pattern is shown by a dotted line, whereas the feed line pattern is shown by a solid line. A high-frequency connector was connected to the input terminal 109, and the produced antenna was connected to a measurement system via a feed line 115 having a characteristic impedance corresponding to 50Ω. As shown in the figure, a loop line 209 was introduced where the feed line 115 intersected the slot region 109. The loop line 209 was a square-shaped loop line with a line width W2, each of whose sides was a2. As Comparative Example 1, a variable slot antenna was also produced which lacked a loop line 209, such that its feeding structure intersected a slot region 109 with the unchanged line width W1 of a characteristic impedance of 50Ω. The ground conductor 101 was separated at the center into finite ground conductor regions 101*a* and 101*b*, sandwiching a slot region 109. Two selective conduction paths 119 and 121 were set astride the slot region 109. As the high-frequency switching elements within the selective conduction paths, commercially-available gallium arsenide PIN diodes were used. The PIN diodes used each had an insertion loss of 0.3 dB at 5 GHz in a conducting state, and a separation of 25 dB at 5 GHz in an open state, which are quite unproblematic values in practice. Via a 1 kΩ resistor, a bias circuit was connected to the ground conductor region 101*b*, thus realizing biasing for the diode. By placing the diodes in the selective conduction paths 119 and 121 in opposite polarities, a driving mode was set so that, while one of the selective conduction paths 119 and 121 was operating to conduct, the other would be operating to be open. The structural parameters of Example 1 shown in FIG. 19 are summarized in Table 2, against the structural parameters of Comparative Example 1.

TABLE 2

| | Example 1 | Comparative Example 1 |
|---|---|---|
| W1 | 0.85 mm | 0.85 mm |
| Ls | 14 mm | 14 mm |
| Ws | 0.4 mm | 0.4 mm |
| a2 | 2.4 mm | — |
| W2 | 0.4 mm | — |
| a | 20 mm | 20 mm |
| b | 45 mm | 45 mm |
| Lo | 3 mm | 3 mm |
| t3 | 14 mm | 14 mm |

Figure 20:
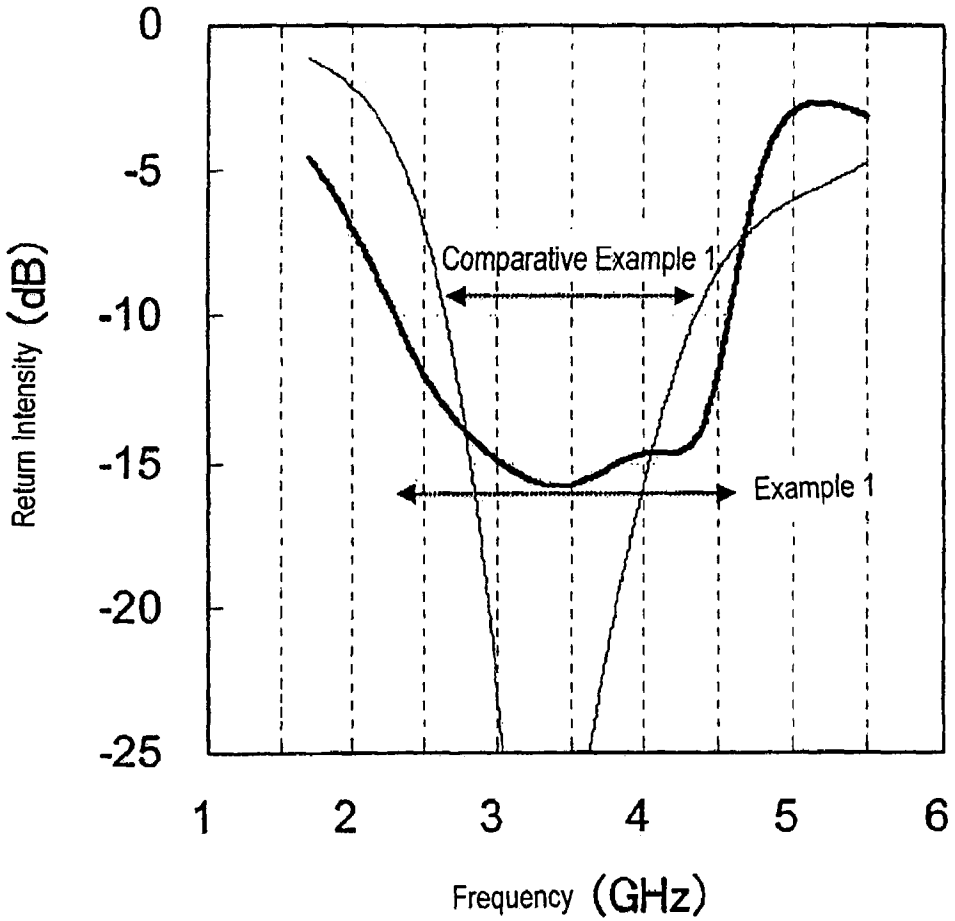
FIG. 20 is a frequency dependence graph of return characteristics of the variable antenna of Example 1 in a first driving state.
Figure 21B:
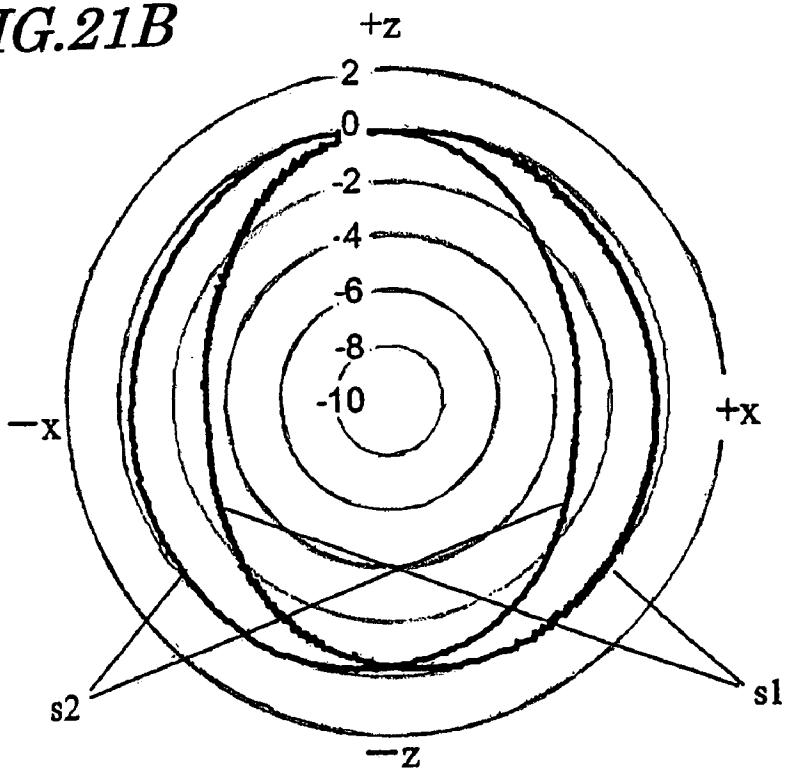
FIGS. 21A and 21B are radiation characteristics diagrams of the variable antenna of Example 1.
Figure 21A:
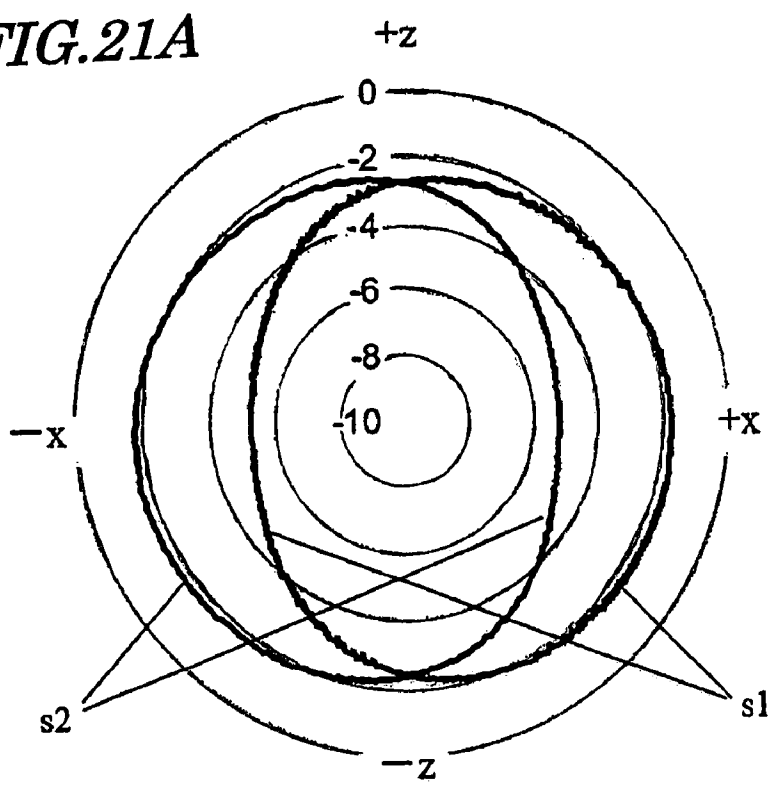

In the first driving state, by allowing the selective conduction path 119 to conduct and allowing the selective conduction path 121 to open, emission in the +X direction in the coordinate system in the figure was obtained across a broad frequency band. FIG. 19 corresponds to a schematic structural diagram in the first driving state. In the second driving state, an opposite bias was supplied to the ground conductor region, and by allowing the selective conduction path 119 to open and allowing the selective conduction path 121 to conduct, an emission in the −X direction was obtained across a broad frequency band. The return characteristics in the first driving state are shown in FIG. 20, against the return characteristics of Comparative Example 1 in the first driving state. The frequency band in which good return characteristics values of −10 dB or less were obtained was from 2.3 GHz to 4.7 GHz in Example 1, as opposed to from 2.7 GHz to 4.3 GHz in Comparative Example 1, indicative of a great improvement on both of the low-frequency side and the high-frequency side. Against the bandwidth ratio of 45% in Comparative Example 1, Example 1 had an improved bandwidth ratio of 68.6%. Also in the second driving state, similar return characteristics were obtained in substantially the same frequency band. FIGS. 21A and 21B show the radiation characteristics in the first driving state and the second driving state, at 2.5 GHz and 4.5 GHz, respectively. Shown in these figures are the radiation directivities in the XZ plane in the coordinate system of FIG. 19. In the figures, s1 represents a radiation directivity in the first driving state, whereas s2 represents a radiation directivity in the second driving state. As will be clear from FIGS. 20, 21A, and 21B, while obtaining substantially equivalent and good return characteristics in two states across a broad frequency band, the main beam direction was in the same direction across the broad frequency band, and it was possible to completely switch the main beam direction between two states.

Figure 22:
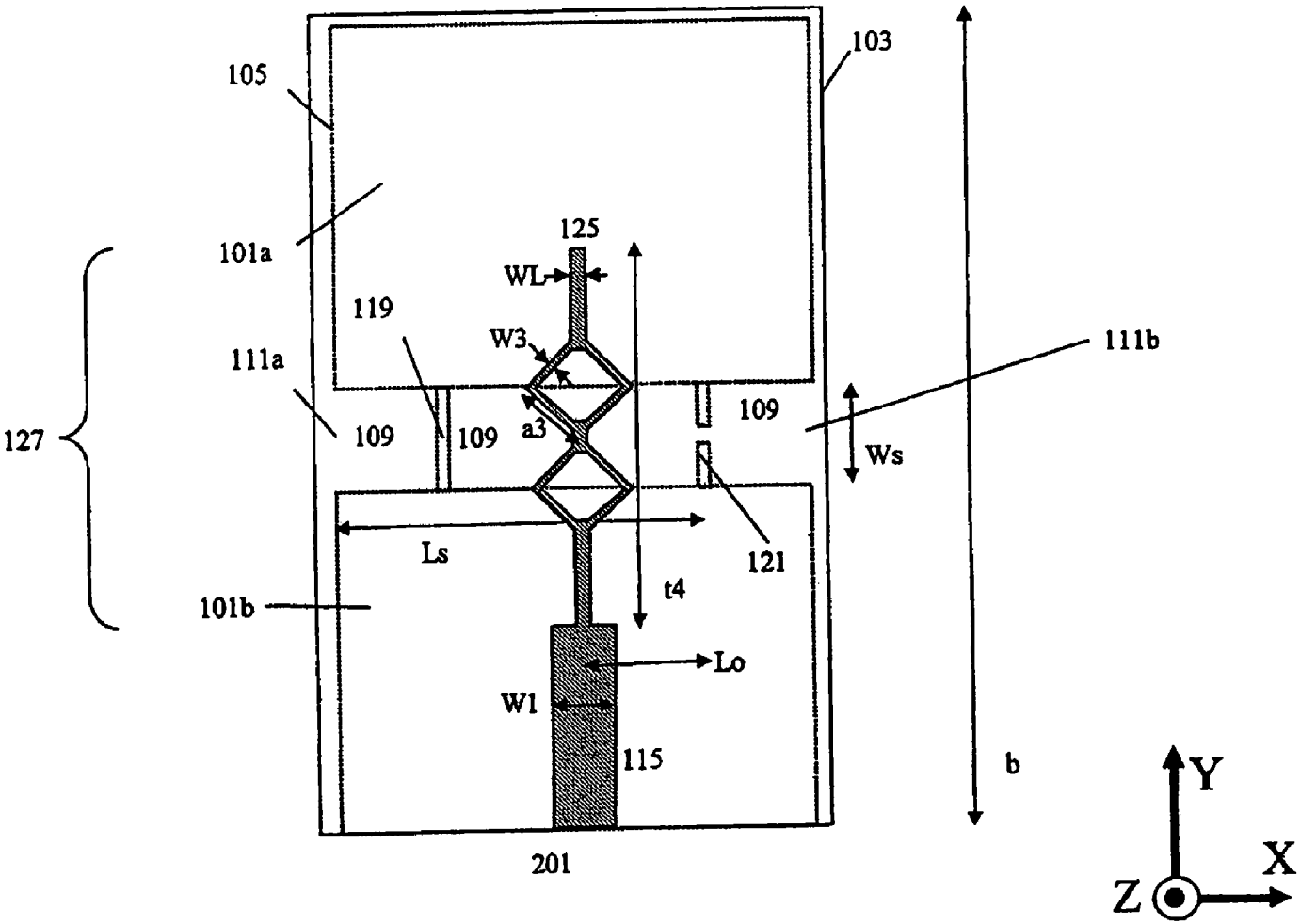
FIG. 22 is a structural diagram of a variable antenna according to Example 2.

Next, a variable slot antenna of Example 2 was produced, as shown in a schematic see-through view (through an upper face) of FIG. 22. The structural parameters of Example 2 are summarized in Table 3. In Example 2, the feed line 115 of a region spanning the length of t4 from the open end 125 was replaced by an inductive resonator region 127, with two square-shaped loop lines 209 introduced therein in series connection. Moreover, it was ensured that the central portion of the inductive resonator region 127 corresponded to the slot feeding site.

TABLE 3

| | Example 2 | Comparative Example 2 |
|---|---|---|
| W1 | 0.85 mm | 0.85 mm |
| WL | 0.25 mm | 0.25 mm |
| Ls | 11.9 mm | 11.9 mm |
| Ws | 3 mm | 3 mm |
| a3 | 1.6 mm | — |
| W3 | 0.2 mm | — |
| a | 15.8 mm | 15.8 mm |
| b | 35 mm | 35 mm |
| Lo | 4 mm | 4 mm |
| t3 | 10 mm | 10 mm |

Figure 23:
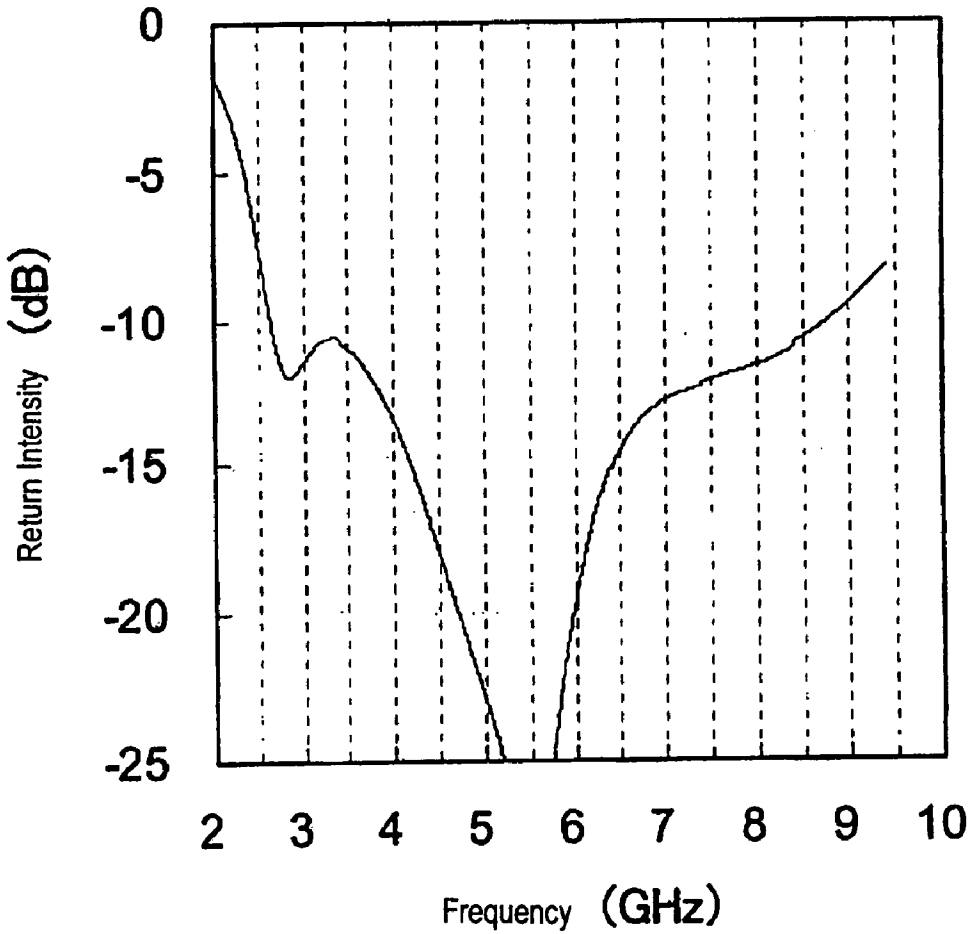
FIG. 23 is a frequency dependence graph of return characteristics of the variable antenna of Example 2 in a first driving state.
Figures 24A, 24B, 24C:
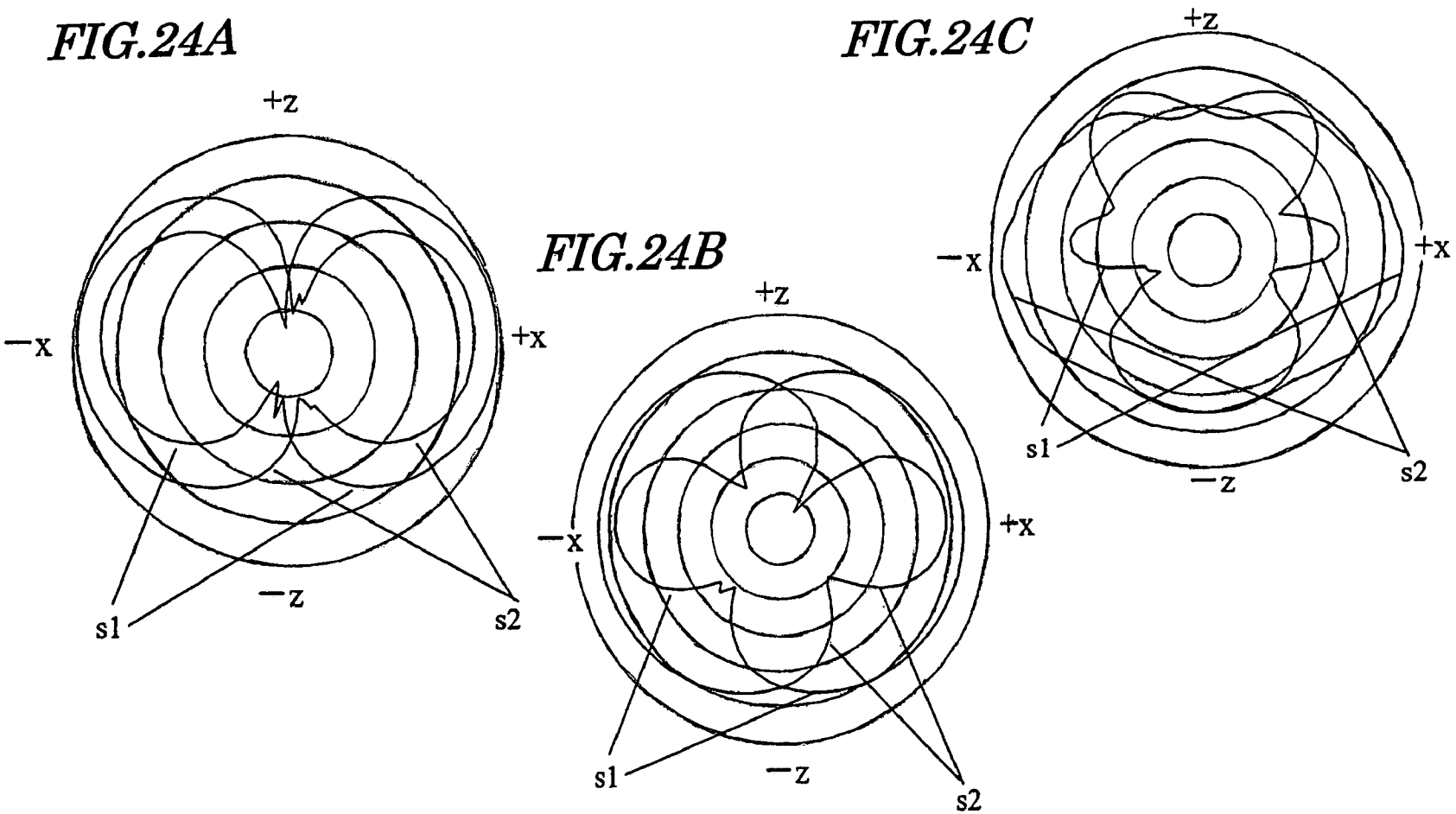
FIGS. 24A, 24B, and 24C are radiation characteristics diagrams of the variable antenna of Example 2.

Return characteristics of Example 2 in the first driving state are shown in FIG. 23. In Example 2, a good return loss value of −10 dB or less in a frequency band from 2.63 GHz to 8.8 GHz was obtained. This band corresponds to wideband characteristics of 108% as converted into bandwidth ratio, which is a much superior value to the bandwidth ratio of 65%, which was attained by Comparative Example 2 (a variable slot antenna lacking a loop line) in the first driving state. Also in the second driving state, almost similar return characteristics were obtained. FIGS. 24A, 24B, and 24C show radiation characteristics of Example 2 in the first driving state and the second driving state, at 3 GHz, 6 GHz, and 9 GHz, respectively. Shown in these figures are the radiation directivities in the XZ plane in the coordinate system of FIG. 22. In the figures, s1 represents a radiation directivity in the first driving state, whereas s2 represents a radiation directivity in the second driving state. As will be clear from FIGS. 23, 24A, 24B, and 24C, while obtaining substantially equivalent and good return characteristics in two states across a broad frequency band, the main beam direction was in the same direction across a broad frequency band, and it was possible to globally switch the main beam direction between two states in a substantially completely mirror symmetrical manner.

Thus, it has been illustrated that the variable slot antenna according to the present invention realizes a drastic switching function of globally switching the main beam direction while maintaining the same main beam direction within the operating band, in spite of its small circuit footprint.

With the variable slot antenna according to the present invention, it is possible to simultaneously attain expansion of the operating band, maintenance of the same main beam direction within the operating band, and a function of globally switching the main beam direction in a drastic manner, without an increase in circuit footprint. Thus, with a simple construction, it is possible to realize a multi-functional terminal device which would conventionally have required mounting a plurality of large wideband antennas. The variable slot antenna according to the present invention also contributes to the realization of a short-range wireless communication system, which exploits a much wider frequency band than conventionally. The present invention also makes it possible to introduce a small-sized antenna having switchability also in a system which requires ultrawideband frequency characteristics where digital signals are transmitted or received wirelessly.

The technological concept to be grasped from the above description shall be as follows.

A variable directivity slot antenna comprising: a dielectric substrate (103); and a ground conductor (101) and a slot region (109) formed on a rear face of the dielectric substrate (103), the ground conductor (101) having a finite area.

The slot region (109) divides the ground conductor (101) into two regions, i.e., a first ground conductor (101*a*) and a second ground conductor (101*b*).

Both leading ends of the slot region (109) are open ends (111*a*, 111*b*).

Two selective conduction paths (119, 121) are further provided on the rear face of the dielectric substrate (103), the two selective conduction paths (119, 121) traversing the slot region (109) to connect the first ground conductor (101*a*) and the second ground conductor (101*b*).

A feed line (115) intersecting the slot region (109) at a feeding site (113) near a center of the slot region (109) along a longitudinal direction thereof is provided on a front face of the dielectric substrate (103).

The two selective conduction paths (119, 121) include a first selective conduction path (119) and a second selective conduction path (121).

In a see-through plan view in which the variable directivity slot antenna is seen through from a normal direction of the dielectric substrate (103), the feed line (115) appears interposed between the first selective conduction path (119) and the second selective conduction path (121).

A slot resonator length Ls is defined as a distance between the first selective conduction path (119) and the open end (111*b*) of the slot region (109) located at the leading end in an −X direction. A slot width Ws is defined as a distance between the first ground conductor (101*a*) and the second ground conductor (101*b*).

When Ws is equal to or less than (Ls/8), Ls is prescribed equal to a ¼ effective wavelength at a center frequency f0 of an operating band.

When Ws exceeds (Ls/8), (2Ls+Ws) is prescribed equal to a ½ effective wavelength at the center frequency f0 of the operating band.

In a first state, the first selective conduction path (119) is selected to be in a conducting state and the second selective conduction path (121) is selected to be in an open state, thus causing a main beam to be emitted (123*a*) in the −X direction. In a second state, the first selective conduction path (119) is selected to be in an open state and the second selective conduction path (121) is selected to be in a conducting state, thus causing a main beam to be emitted (123*b*) in the X direction.

The feed line (113) once branches into a group of branch lines (115*a*, 115*b*) including two or more branch lines at a first point (221) near the feeding site (113), and two or more branch lines (115*a*, 115*b*) in the group of branch lines become again connected at a second point (223) near the slot (109), thus forming a loop line (209) in the feed line (115). A maximum value of a loop length of the entire loop line is prescribed to be a length less than 1×effective wavelength at an upper limit frequency of the operating band.

While the present invention has been described with respect to preferred embodiments thereof, it will be apparent to those skilled in the art that the disclosed invention may be modified in numerous ways and may assume many embodiments other than those specifically described above. Accordingly, it is intended by the appended claims to cover all modifications of the invention that fall within the true spirit and scope of the invention.

What is claimed is:

1. A variable directivity slot antenna comprising:

a dielectric substrate; and a ground conductor and a slot region formed on a rear face of the dielectric substrate, the ground conductor having a finite area, wherein, the slot region divides the ground conductor into a first ground conductor and a second ground conductor;

both leading ends of the slot region are open ends;

at least two selective conduction paths are further provided on the rear face of the dielectric substrate, the at least two selective conduction paths traversing the slot region to connect the first ground conductor and the second ground conductor;

a feed line intersecting the slot region at a feeding site near a center of the slot region along a longitudinal direction thereof is provided on a front face of the dielectric substrate;

the at least two selective conduction paths include a first selective conduction path and a second selective conduction path;

a slot resonator length Ls is defined as a distance between the first selective conduction path and the open end of the slot region located at the leading end in an −X direction;

a slot width Ws is defined as a distance between the first ground conductor and the second ground conductor;

a distance between the second selective conduction path and the open end of the slot region located at the leading end in an X direction is equal to the slot resonator length Ls;

when Ws is equal to or less than (Ls/8), Ls is prescribed equal to a ¼ effective wavelength at a center frequency f0 of an operating band;

when Ws exceeds (Ls/8), (2Ls+Ws) is prescribed equal to a ½ effective wavelength at the center frequency f0 of the operating band;

in a see-through plan view in which the variable directivity slot antenna is seen through from a normal direction of the dielectric substrate, the feed line appears interposed between the first selective conduction path and the second selective conduction path;

the X direction is defined as the longitudinal direction of the slot region, a Y direction is defined as a longitudinal direction of the feed line, and a Z direction is defined as the normal direction of the dielectric substrate;

the first selective conduction path is disposed between the open end of the slot region located at the leading end in the X direction and the feeding site, and the second selective conduction path is disposed between the open end of the slot region located at the leading end in the −X direction and the feeding site;

in a first state, the first selective conduction path is selected to be in a conducting state and the second selective conduction path is selected to be in an open state, thus causing a main beam to be emitted in the −X direction;

in a second state, the first selective conduction path is selected to be in an open state and the second selective conduction path is selected to be in a conducting state, thus causing a main beam to be emitted in the X direction;

the feed line once branches into a group of branch lines including two or more branch lines at a first point near the feeding site, and two or more branch lines in the group of branch lines become again connected at a second point near the slot, thus forming a loop line in the feed line; and a maximum value of a loop length of the entire loop line is prescribed to be a length less than 1×effective wavelength at an upper limit frequency of the operating band.

2. The variable directivity slot antenna of claim 1, wherein at least one said loop line intersects a border line between the slot region and a ground conductor, and the slot region is excited at two or more feed points which are at different distances from an open point of the slot region.

3. The variable directivity slot antenna of claim 1, wherein, the feed line of a region spanning a length of a ¼ effective wavelength at the center frequency of the operating band from an open end point is an inductive resonator region composed of a transmission line having a characteristic impedance higher than 50Ω; and the feed line and the slot region at least partially intersect each other in the inductive resonator region.

4. The variable directivity slot antenna of claim 1, wherein a sum total of line widths of the branch lines into which the feed line branches is prescribed equal to or less than a line width of a transmission line having a characteristic impedance of 50Ω on the same substrate.

5. The variable directivity slot antenna of claim 1, wherein a lowest-order resonant frequency of the ground conductor in the first and second states is prescribed to be lower than the operating band of the variable slot antenna.

6. The variable directivity slot antenna of claim 1, wherein the feed line and the slot region are shaped so as to be mirror symmetrical near the feeding site, and the first direction and the second direction are mirror symmetrical directions.

7. The variable directivity slot antenna of claim 6, wherein the first direction and the second direction are parallel and opposite.

8. The variable directivity slot antenna of claim 1, wherein, the first selective conduction path includes plural portions;

in the first state, at least one of the plural portions of the first selective conduction path is selected to be in a conducting state and the second selective conduction path is selected to be in an open state, thus causing a main beam to be emitted in the −X direction; and in the second state, all of the plural portions of the first selective conduction path are selected to be in an open state and the second selective conduction path is selected to be in a conducting state, thus causing a main beam to be emitted in the X direction.

9. The variable directivity slot antenna of claim 1, wherein, the second selective conduction path includes plural portions;

in the first state, the first selective conduction path is selected to be in a conducting state and all of the plural portions of the second selective conduction path are selected to be in an open state, thus causing a main beam to be emitted in the −X direction; and in the second state, the first selective conduction path is selected to be in an open state and at least one of the plural portions of the second selective conduction path is selected to be in a conducting state, thus causing a main beam to be emitted in the X direction.

10. The variable directivity slot antenna of claim 1, wherein the slot region includes a portion in which the slot width has a tapered increased toward each open end.

11. The variable directivity slot antenna of claim 1, wherein portions of outer perimeters of the first ground conductor and the second ground conductor that oppose each other via the slot region have a planar shape with a plurality of protrusions and depressions flanking along the X direction when viewed from the Z direction.

12. A driving method for a variable directivity slot antenna, the variable directivity slot antenna including:

a dielectric substrate; and a ground conductor and a slot region formed on a rear face of the dielectric substrate, the ground conductor having a finite area, wherein, the slot region divides the ground conductor into a first ground conductor and a second ground conductor;

both leading ends of the slot region are open ends;

at least two selective conduction paths are further provided on the rear face of the dielectric substrate, the at least two selective conduction paths traversing the slot region to connect the first ground conductor and the second ground conductor;

a feed line intersecting the slot region at a feeding site near a center of the slot region along a longitudinal direction thereof is provided on a front face of the dielectric substrate;

the at least two selective conduction paths include a first selective conduction path and a second selective conduction path;

a slot resonator length Ls is defined as a distance between the first selective conduction path and the open end of the slot region located at the leading end in an −X direction;

a slot width Ws is defined as a distance between the first ground conductor and the second ground conductor;

a distance between the second selective conduction path and the open end of the slot region located at the leading end in an X direction is equal to the slot resonator length Ls;

when Ws is equal to or less than (Ls/8), Ls is prescribed equal to a ¼ effective wavelength at a center frequency f0 of an operating band;

when Ws exceeds (Ls/8), (2Ls+Ws) is prescribed equal to a ½ effective wavelength at the center frequency f0 of the operating band;

in a see-through plan view in which the variable directivity slot antenna is seen through from a normal direction of the dielectric substrate, the feed line appears interposed between the first selective conduction path and the second selective conduction path;

the X direction is defined as the longitudinal direction of the slot region, a Y direction is defined as a longitudinal direction of the feed line, and a Z direction is defined as the normal direction of the dielectric substrate;

the first selective conduction path is disposed between the open end of the slot region located at the leading end in the X direction and the feeding site, and the second selective conduction path is disposed between the open end of the slot region located at the leading end in the −X direction and the feeding site;

the feed line once branches into a group of branch lines including two or more branch lines at a first point near the feeding site, and two or more branch lines in the group of branch lines become again connected at a second point near the slot, thus forming a loop line in the feed line; and a maximum value of a loop length of the entire loop line is prescribed to be a length less than 1×effective wavelength at an upper limit frequency of the operating band, the method comprising:

a first step of selecting the first selective conduction path to be in a conducting state and selecting the second selective conduction path to be in an open state, thus causing a main beam to be emitted in the −X direction; and a second step of selecting the first selective conduction path to be in an open state and selecting the second selective conduction path to be in a conducting state, thus causing a main beam to be emitted in the X direction.

13. The driving method for a variable directivity slot antenna of claim 12, wherein at least one said loop line intersects a border line between the slot region and a ground conductor, and the slot region is excited at two or more feed points which are at different distances from an open point of the slot region.

14. The driving method for a variable directivity slot antenna of claim 12, wherein, the feed line of a region spanning a length of a ¼ effective wavelength at the center frequency of the operating band from an open end point is an inductive resonator region composed of a transmission line having a characteristic impedance higher than 50Ω; and the feed line and the slot region at least partially intersect each other in the inductive resonator region.

15. The driving method for a variable directivity slot antenna of claim 12, wherein a sum total of line widths of the branch lines into which the feed line branches is prescribed equal to or less than a line width of a transmission line having a characteristic impedance of 50Ω on the same substrate.

16. The driving method for a variable directivity slot antenna of claim 12, wherein a lowest-order resonant frequency of the ground conductor in the first and second steps is prescribed to be lower than the operating band of the variable directivity slot antenna.

17. The driving method for a variable directivity slot antenna of claim 12, wherein the feed line and the slot region are shaped so as to be mirror symmetrical near the feeding site, and the first direction and the second direction are mirror symmetrical directions.

18. The driving method for a variable directivity slot antenna of claim 17, wherein the first direction and the second direction are parallel and opposite.

19. The driving method for a variable directivity slot antenna of claim 12, wherein, the first selective conduction path includes plural portions;

in the first step, at least one of the plural portions of the first selective conduction path is selected to be in a conducting state and the second selective conduction path is selected to be in an open state, thus causing a main beam to be emitted in the −X direction; and in the second step, all of the plural portions of the first selective conduction path are selected to be in an open state and the second selective conduction path is selected to be in a conducting state, thus causing a main beam to be emitted in the X direction.

20. The driving method for a variable directivity slot antenna of claim 12, wherein, the second selective conduction path includes plural portions;

in the first step, the first selective conduction path is selected to be in a conducting state and all of the plural portions of the second selective conduction path are selected to be in an open state, thus causing a main beam to be emitted in the −X direction; and in the second step, the first selective conduction path is selected to be in an open state and at least one of the plural portions of the second selective conduction path is selected to be in a conducting state, thus causing a main beam to be emitted in the X direction.

21. The driving method for a variable directivity slot antenna of claim 12, wherein the slot region includes a portion in which the slot width has a tapered increased toward each open end.

22. The driving method for a variable directivity slot antenna of claim 12, wherein portions of outer perimeters of the first ground conductor and the second ground conductor that oppose each other via the slot region have a planar shape with a plurality of protrusions and depressions flanking along the X direction when viewed from the Z direction.

* * * * *